US012663181B2

(12) United States Patent
Shaffer

(10) Patent No.: US 12,663,181 B2
(45) **Date of Patent: *Jun. 23, 2026**

(54) HOT WATER TANK AND FLOW THROUGH HEATING ASSEMBLY

(71) Applicant: NATIONAL MACHINE COMPANY, Stow, OH (US)

(72) Inventor: Ronald Shaffer, Stow, OH (US)

(73) Assignee: NATIONAL MACHINE COMPANY, Stow, OH (US)

( * ) Notice: Subject to any disclaimer, the term of this patent is extended or adjusted under 35 U.S.C. 154(b) by 3 days.

This patent is subject to a terminal disclaimer.

(21) Appl. No.: 18/539,861

(22) Filed: Dec. 14, 2023

(65) Prior Publication Data

US 2024/0151434 A1 May 9, 2024

Related U.S. Application Data

(63) Continuation of application No. 16/618,718, filed as application No. PCT/US2018/035663 on Jun. 1, 2018, now Pat. No. 11,892,198.

(Continued)

(51) Int. Cl.
*F24H 9/20* (2022.01)
*F24H 1/10* (2022.01)

(Continued)

(52) U.S. Cl.
CPC ..... *F24H 9/0021* (2013.01); *F24H 1/122* (2013.01); *F24H 9/136* (2022.01); *F24H 9/2021* (2013.01);

(Continued)

(58) Field of Classification Search
CPC ..... F24H 9/0021; F24H 9/136; F24H 9/1818; F24H 9/2021; F24H 1/122; F24H 1/101;

(Continued)

(56) References Cited

U.S. PATENT DOCUMENTS 1,356,881 A 10/1920 Osgood
2,041,630 A * 5/1936 Wright ..... F24H 9/0021 392/452

(Continued)

FOREIGN PATENT DOCUMENTS

EP 0221210 5/1987
GB 343145 A 2/1931

(Continued)

OTHER PUBLICATIONS

International Search Report and Written Opinion of the International Searching Authority for International Application No. PCT/US18/35663. Dated Aug. 28, 2018.

(Continued)

*Primary Examiner* — Steven S Anderson, II

(74) *Attorney, Agent, or Firm* — Vorys, Sater, Seymour and Pease LLP; D. Jeremy Harrison

(57) ABSTRACT

A water heater includes a hollow body having an inlet and an outlet, a heating element arranged within the hollow body, a cavity formed between a heating surface of the heating element and an interior surface of the hollow body, an outlet tube, and an adapter sleeve. The outlet tube extends externally from the outlet of the hollow body towards the inlet of the hollow body for depositing heated fluid within the fluid tank, wherein the outlet tube is in fluid communication with the inlet of the hollow body. The adapter sleeve arranged at a lower end of the hollow body, wherein the inlet of the hollow body is arranged in the adapter sleeve.

18 Claims, 17 Drawing Sheets

Related U.S. Application Data

(60) Provisional application No. 62/514,076, filed on Jun. 2, 2017.

(51) Int. Cl.

| | |
|---|---|
| ***F24H 1/12*** | (2022.01) |
| ***F24H 1/20*** | (2022.01) |
| ***F24H 9/00*** | (2022.01) |
| ***F24H 9/13*** | (2022.01) |
| ***F24H 15/14*** | (2022.01) |
| ***F24H 15/184*** | (2022.01) |
| ***F24H 15/225*** | (2022.01) |
| ***F24H 15/315*** | (2022.01) |
| ***H05B 3/42*** | (2006.01) |
| ***H05B 3/82*** | (2006.01) |
| *F24H 9/1818* | (2022.01) |
| *F24H 15/219* | (2022.01) |
| *F24H 15/281* | (2022.01) |
| *F24H 15/34* | (2022.01) |
| *F24H 15/37* | (2022.01) |
| *F24H 15/414* | (2022.01) |

(52) U.S. Cl.
CPC ..... *F24H 15/14* (2022.01); *F24H 15/184* (2022.01); *F24H 15/225* (2022.01); *F24H 15/315* (2022.01); *F24H 9/1818* (2013.01); *F24H 15/219* (2022.01); *F24H 15/281* (2022.01); *F24H 15/34* (2022.01); *F24H 15/37* (2022.01); *F24H 15/414* (2022.01)

(58) Field of Classification Search
CPC ..... F24H 1/201; F24H 1/202; F24H 1/205; F24H 1/206; F24H 1/207; F24H 1/203; H05B 3/42; H05B 3/82; H05B 1/0283
See application file for complete search history.

(56) References Cited

U.S. PATENT DOCUMENTS

| | | | | |
|---|---|---|---|---|
| 2,521,960 | A | | 9/1950 | Arvintz et al. |
| 2,763,764 | A | | 9/1956 | Vidalenq |
| 3,383,495 | A | | 5/1968 | Laube et al. |
| 3,484,580 | A | | 12/1969 | Morgan |
| 3,580,224 | A | | 5/1971 | Rouet et al. |
| 3,614,386 | A | * | 10/1971 | Hepplewhite ..... F24H 1/202 392/452 |
| 4,238,666 | A | | 12/1980 | Pomper |
| 4,282,421 | A | | 8/1981 | Hadar |
| 4,506,140 | A | | 3/1985 | Armstrong |
| 2010/0034528 | A1 | | 2/2010 | Willis et al. |
| 2010/0296800 | A1 | | 11/2010 | Min et al. |
| 2012/0051724 | A1 | | 3/2012 | Abraham |

FOREIGN PATENT DOCUMENTS

| | | | | |
|---|---|---|---|---|
| GB | 468427 | A | * | 7/1937 |
| GB | 529662 | | | 11/1940 |
| GB | 2525786 | A | | 11/2015 |
| WO | 2017015593 | A | | 1/2017 |

OTHER PUBLICATIONS

International Preliminary Report on Patentability issued Dec. 3, 2019 for International Application No. PCT/US2018/035663.

* cited by examiner

FIG. 9
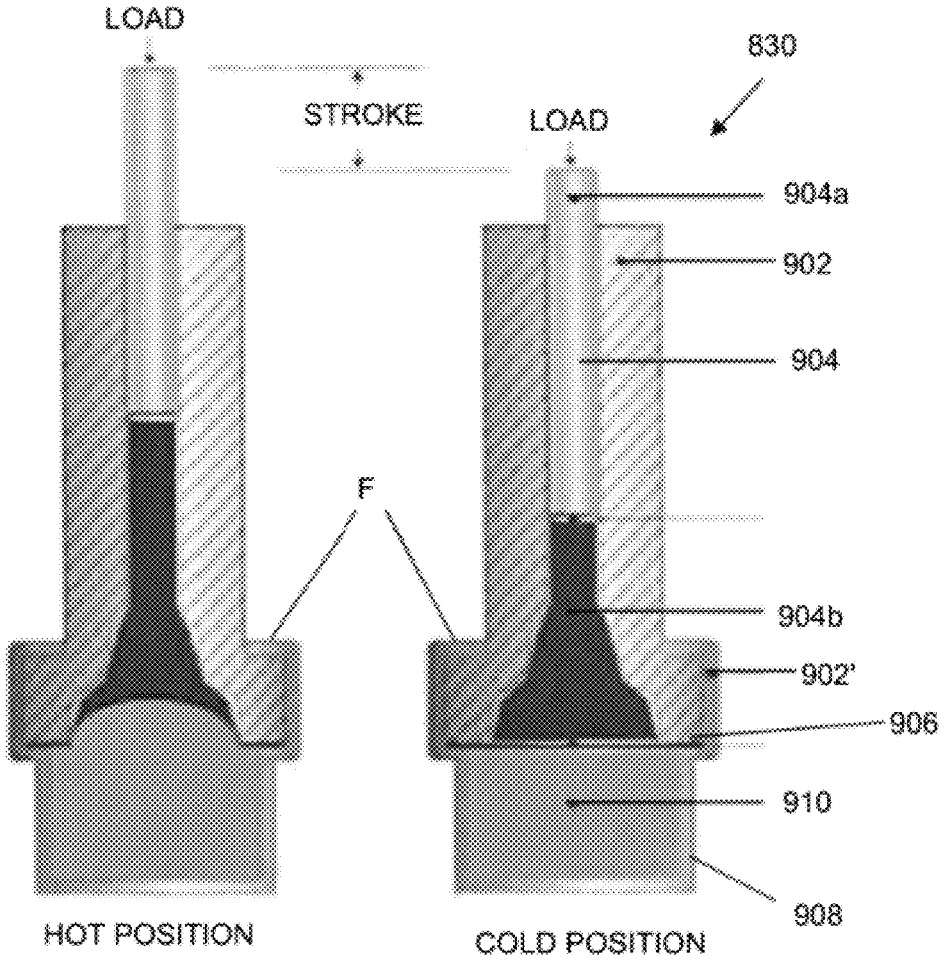
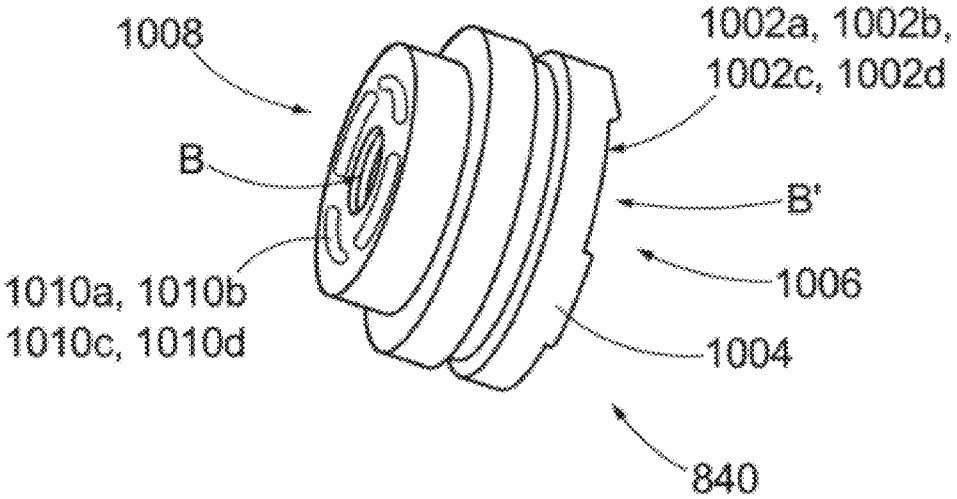
FIG. 10A

HOT WATER TANK AND FLOW THROUGH HEATING ASSEMBLY

CROSS-REFERENCE TO RELATED APPLICATIONS

This application claims priority to U.S. patent application Ser. No. 16/618,718, filed Dec. 2, 2019, which is National Stage of International Application No. PCT/US2018/035663, filed Jun. 1, 2018, which claims priority to U.S. Patent Application Ser. No. 62/514,076 filed Jun. 2, 2017, all of which are incorporated by reference herein in their entirety.

FIELD OF THE INVENTION

Various configurations of the current invention relate generally to apparatus, systems, and methods for heating water. More particularly, the apparatus, systems, and methods relate to heating water in a water tank. Specifically, the apparatus, systems, and methods provide for heating water with a flow-through heating element located in a lower portion of a water tank.

BACKGROUND OF THE INVENTION

Heated water is customarily provided in commercial aircraft lavatories for hand-washing purposes as well as in galleys for food and hot beverage preparation. There are a number of requirements for such systems that place many limitations on the designs which may be satisfactorily employed. A suitable system should provide needed heated water in as an efficient manner as possible. The amount of electrical power used for heating is limited because aircraft minimize the weight and cost of equipment and the use of less power helps accomplish these goals. It is also desired to keep repair and replacement expenses to a minimum.

One widely-used system accomplishes some of these goals but also has certain deficiencies. That system employs a tank containing two or more electrical heating elements immersed in water. A major shortcoming of that system is that a portion of water is in contact with the heater and is heated to a high temperature, possibly even boiling. This type of water heater may have the undesirable consequence that over time calcification or other impurities form mineral deposits on the heating elements. The deposits are poor thermal conductors and hence, overtime, additional power is required to heat the water. Further, the deposits hasten the need to replace the heating elements or the entire unit. What is needed is a better water heater.

SUMMARY OF THE INVENTION

One embodiment is a heater. The heater includes a hollow body configured to couple to an interior of a fluid tank, the hollow body having an inlet and an outlet that is in fluid communication with the inlet, the inlet being spaced away from the outlet; a heating element arranged within the hollow body, the heating element having a heating surface configured to heat fluid flowing through the hollow body; a cavity formed between the heating surface of the heating element and an interior surface of the hollow body; an outlet tube extending externally from the outlet of the hollow body towards the inlet of the hollow body for depositing heated fluid within the fluid tank, wherein the outlet tube is in fluid communication with the inlet of the hollow body; and an adapter sleeve arranged at a lower end of the hollow body, wherein the inlet of the hollow body is arranged in the adapter sleeve.

Another embodiment is a heater that includes a hollow body having an inlet and an outlet that is in fluid communication with the inlet, the inlet located at a bottom end of the hollow body and the outlet spaced away from the inlet towards a top end of the hollow body; a heating element removably arranged within an interior of the hollow body, the heating element being connected to the hollow body at the bottom end of the hollow body, the heating element having a heating surface configured to heat fluid flowing through the hollow body; and an outlet tube extending externally from the outlet of the hollow body towards the inlet of the hollow body for depositing heated fluid, wherein the outlet tube is in fluid communication with the inlet of the hollow body.

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples, one element may be designed as multiple elements or that multiple elements may be designed as one element. In some examples, an element shown as an internal component of another element may be implemented as an external component and vice versa. Furthermore, elements may not be drawn to scale.

FIG. 9 illustrates an embodiment of the thermal actuator utilized in an exemplary thermostatic mixing valve.

FIG. 10A and FIG. 10B illustrate FIG. 10 illustrates an embodiment of the active mixing nozzle utilized in an exemplary thermostatic mixing valve.

Similar numbers refer to similar parts throughout the drawings.

DETAILED DESCRIPTION OF THE DRAWINGS

Figure 1A:
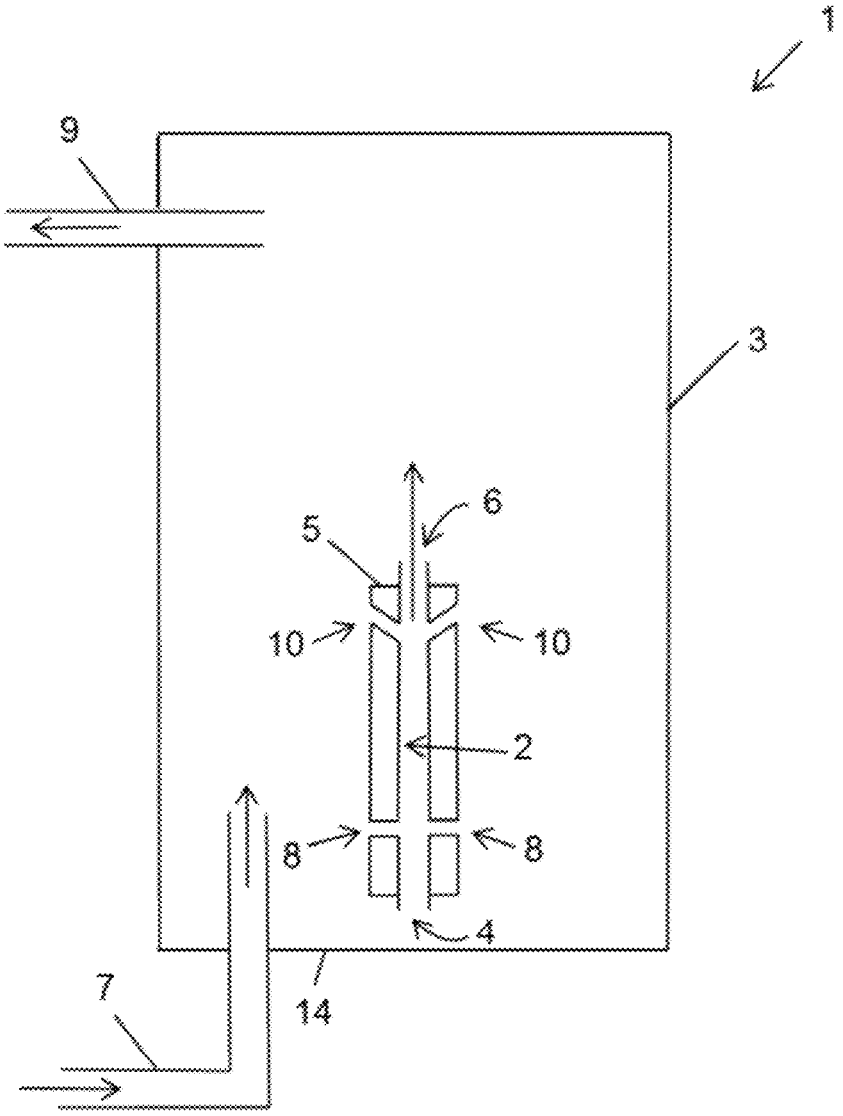
FIG. 1A illustrates a cross-section schematic view of an example first embodiment of a water heater with a flow-through heating element contained within a water tank.

FIG. 1A illustrates a cross-sectional view of a first embodiment of a water heater 1 that includes a water tank 3 and a flow-through heating element 5. Water tank 3 includes an input line 7 for receiving water into water tank 3 from a source of potable water that may be located remote from water heater 1. Initially, when water tank 3 is empty, it may be filled by injecting water into it from input line 7.

Water tank 3 further includes an output line 9 for dispensing heated water from water tank 3. A bottom opening 4 of heating element 5 receives water from tank 3 so that it may be heated and/or reheated by flow-through heating element 5 as the water passes through an interior 2 of the heating element 5 and is re-injected into water tank 3 out of a top opening 6. In some embodiments, flow-through heating element 5 may be a "Watlow" type of inline heater similar to flow-through/inline heaters manufactured by Watlow Electric Manufacturing Company. Additionally, a central tube of the heating element 5 may be a convoluted tube for more efficient heat transfer.

The present invention features a water heater 1 that includes using a flow-through heating element 5 near the base/bottom 14 of water heater 1. In this configuration, heating element 5 is positioned so that its bottom opening 4 is near bottom wall 14 of water tank 3 and the rest of heating element 5 is internal to water tank 3. As discussed below, heating element 5 may be placed in other positions as understood by those of ordinary skill in the art. Positioning heating element 5 near bottom of water tank 3 causes a pressure to be created to recirculate water in water tank 3. This is because the introduction of heated water in this orientation results in the lighter heated water flowing upward toward the top of water tank 3 allowing cooler water to be displaced with this warmer water as the warmer water travels generally upward creating an upward pressure. The upward flowing of heated water that displaces cooler water may act to mix/churn water in water tank 3 so that the water may be more uniformly heated. In some configurations, a fan nozzle may be placed at the upper end of flow-through heating element 5 to disperse heated water as it leaves heating element 5. Other configurations may utilize a directional nozzle at upper opening 6 to direct heated water in a particular direction as it leaves heating element 5 to create a desired circulation between warm and cool water within tank 3. The present invention further utilizes recirculation, temperature differential, and uses positive pressure to heat water rather than simple contacting of a heating coil. The present invention further includes focusing on not increasing surface heating area to heat water but, rather, to running water through flow-through heating element 5 one or more times depending on the configuration of the flow-through heater; however, the surface area of heating the heating element may be increased to further enhance efficiency in some configurations. Water tank 1 of FIG. 1A may be completely filled to maximize water that may be stored in water tank 1 or, alternatively, provide for a smaller water tank that can hold the same amount of water.

In some configurations, flow-through heating element 5 has an elongated interior channel that acts as a conduit allowing flow-through heating element 5 to heat water as it travels from an input end of this channel upward to an output end of the channel. This allows heating element 5 to act as a thermodynamic pump capable of moving water by temperature differences without requiring moving parts. Heating element 5 creates water velocities within water tank 3 that contribute to the reduction in biofilms and bacteria while promoting efficient thermal mixing within water tank 3. Additionally, a pumping velocity changes as the temperature differential from the input end to the output end of flow-through heating element 5 reaches a maximum heating level. The improved thermal mixing also reduces the recovery time when hot water is drawn from water tank 3. This is a significant improvement over prior art water heaters using tubular heating elements which over time may cause thermal stratification contributing to the breakdown of sanitary conditions inside prior art tanks.

In other configurations, flow-through heating element 5 may have one or more optional lower side openings 8 and one or more optional upper openings 10. Lower openings 8 and or bottom opening 4 may allow cool water to enter heating element 5 near its bottom end and to be heated before exiting upper side openings 10 and/or top opening 6. Those of ordinary skill in the art will appreciate that flow-through heating element 5 may have other openings in other positions and or may have elongated conduits extending from its main elongated interior channel to allow water to be pulled into heating element 5 from other places within tank 3 and for heated water to be distributed to other places within tank 3 to maintain an overall desired circulation pattern within tank 3 between cooler and warmer water. In some configurations, elongated conduits extending from its main elongated interior channel may branch out within water tank 3 with a tree shaped pattern.

Figure 1B:
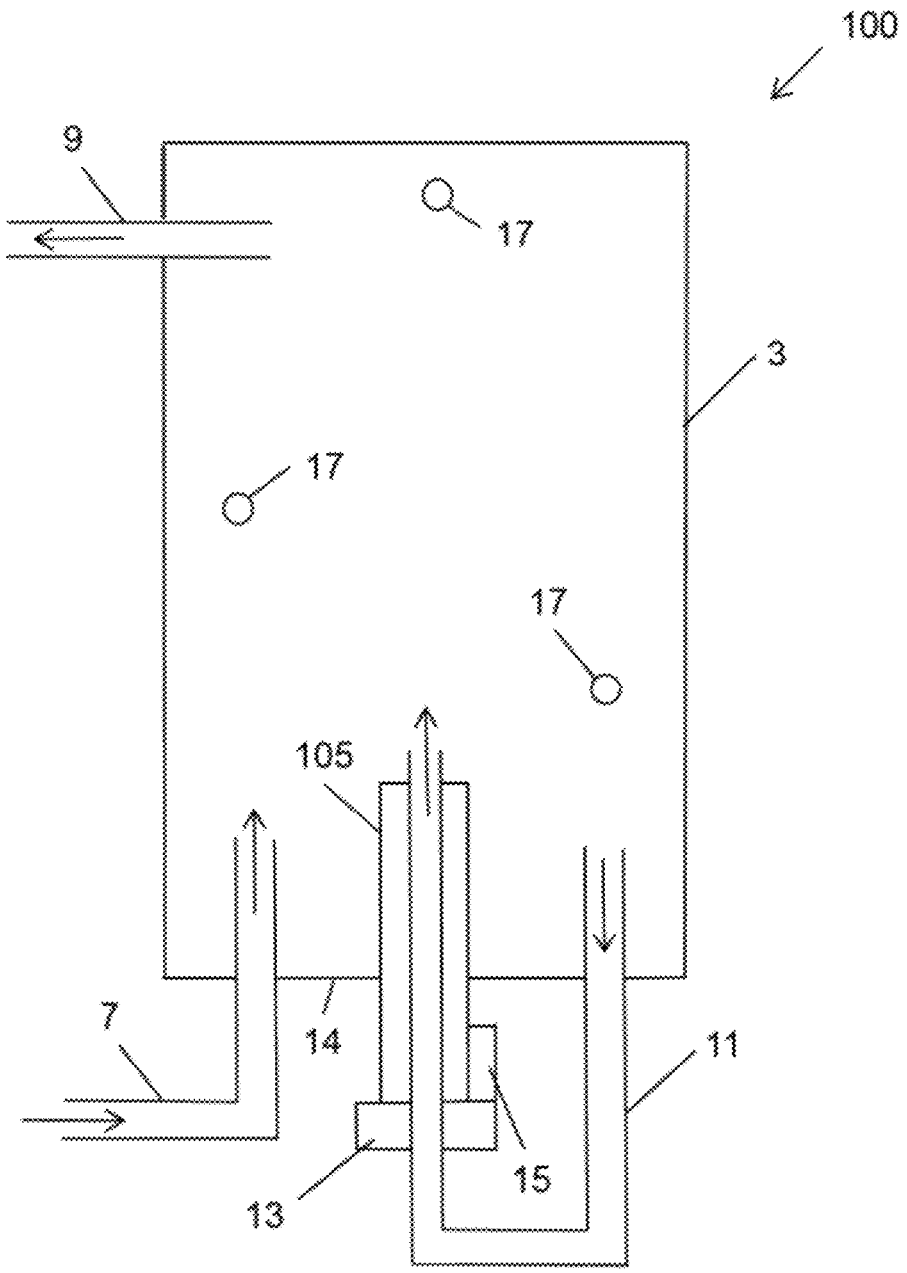
FIG. 1B illustrates a cross-section schematic view of an example second embodiment of a water heater with a flow-through heating element partially extending from a bottom portion of a water tank.

FIG. 1B illustrates another cross-sectional view of a second embodiment of a water heater 100 that also includes water tank 3, a flow-through heating element 105, water input line 7, and output line 9. This configuration additionally includes a recirculation line 11 connected to heating element 105. Recirculation line 11 removes water from water tank 3 and sends it through a flow-through heating element 105 so that it is heated and/or re-heated and re-injected into water tank 3. The present invention features a water heater 100 that includes using a flow-through heating element 105 similar to the heating element of FIG. 1A and that is near the base/bottom 14 of water heater 100. For example, the heating element 105 may be positioned near the base 14 of water heater 100 so that a top end of heating element 105 extends into water tank 3 and a bottom end extends below bottom wall 14 of water tank 3 as illustrated in FIG. 1B. In another configuration, heating element 105 may be positioned so that its top end is near bottom wall 14 of water tank 3 and the rest of heating element 105 is external to water tank 3. As discussed above with reference to FIG. 1A, heating element 105 may be positioned so that its bottom end is near bottom wall 14 of water tank 3 and the rest of heating element 105 is internal to water tank 3. The heating element 105 may be placed in other positions as understood by those of ordinary skill in the art. As previously mentioned and described, positioning heating element 105 near bottom of water tank 3 causes a pressure to be created to recirculate water in water tank 3.

As illustrated in FIG. 1B, some configurations of water heater 100 may include an optional water pump 13 and a controller including control logic 15 to assist flow-through heating element 105 to control a speed that water is recirculated through water tank 3. For example, control logic 15 may evaluate temperatures recorded by different temperature sensors 17 at different locations within water tank 3. During periods of high usage, temperature sensors 17 may detect generally lower temperatures prompting control logic 15 to run pump 13 at a higher speed and/or increasing heat that heating element 105 produces so that more water is heated. Optionally if different temperature sensors 17 record differing temperatures, it may be an indication that water within water tank 3 is not well circulated to, again, cause control logic 15 to run pump 13 at a higher speed and/or increase heat that heating element 105 produces. If temperature sensors 17 detect a temperature above an upper threshold amount, this may cause control logic 15 to turn off or reduce the heat that is produced by heating element 105 and/or to reduce the speed of pump 13 or to turn off pump 13.

It will be appreciated that water heaters according to the present invention may be differently configured, for example, by including differently configured and/or oriented heating elements or heating devices. One such alternate embodiment of a heating device is described below with reference to FIGS. 11-14. It will also be appreciated, however, that even other heater device configurations may be utilized instead, and that these alternate embodiments, while being differently configured and/or oriented, may still include some of the features discussed with reference to other embodiments, such as flow-through heating element 105.

"Logic", as used herein, includes but is not limited to hardware, firmware, software, and/or combinations of each to perform a function(s) or an action(s), and/or, to cause a function or action from another logic, method, and/or system. For example, based on a desired application or need, logic may include a software-controlled microprocessor, discrete logic such as an application-specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

Water heater 100 may be produced sufficiently small so that it may be provided in commercial aircraft lavatories to provide hot water for such uses as washing hands and galleys for the preparation of hot beverages. Preferably, water heater 100 is made with rigid materials as understood by those of ordinary skill in the art. For example, water heater 100 may be produced using metallic pipes and couplings with water tank 3 formed with rigid metallic walls. In some configurations, water tank 3 may be a seamless plastic tank or a tank formed with other materials as understood by those of ordinary skill in the art.

Figure 2:
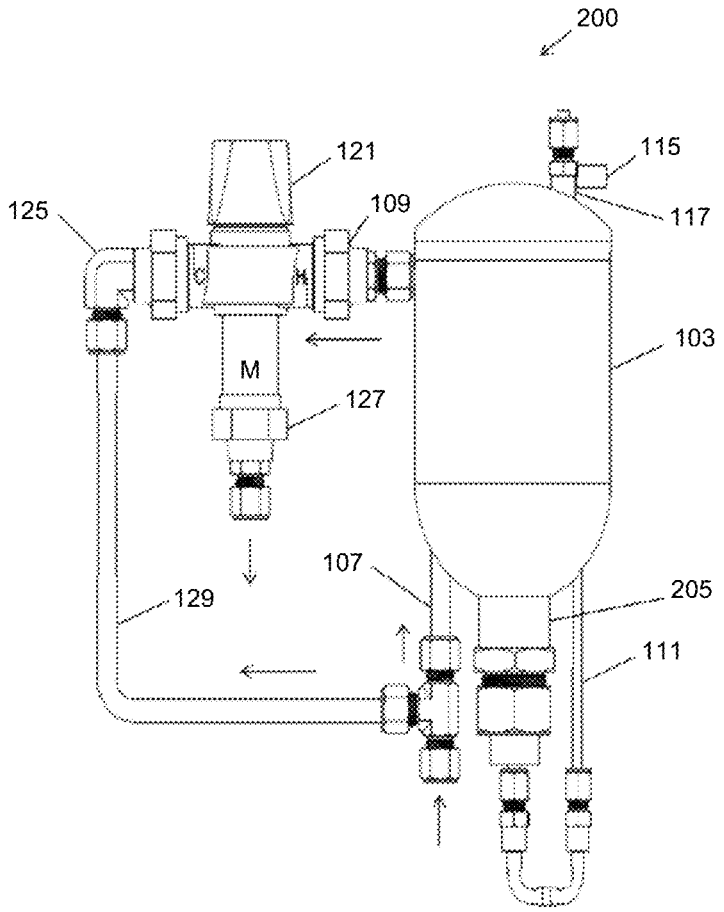
FIG. 2 illustrates a front view of a third embodiment of a water heater.
Figure 3:
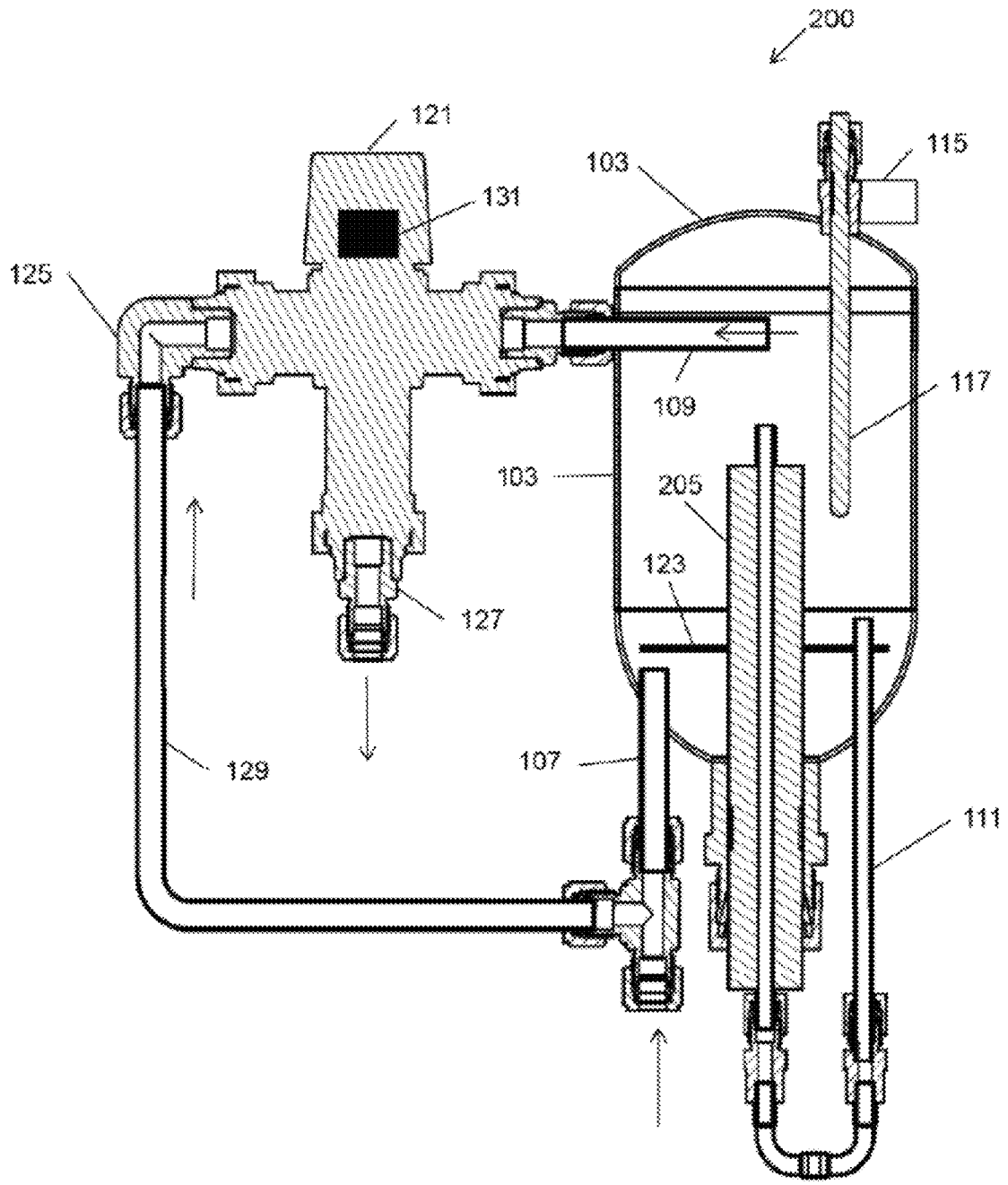
FIG. 3 illustrates a cross-section view of the third embodiment of a water heater.

FIGS. 2 and 3 illustrate a further embodiment of a water heater 200 that in some configurations may be used in aircraft. Similar to water heater 100 of FIG. 1, water heater 200 has a water tank 103, a flow-through heating element 205, a water input line 107, a water output line 109, a water recirculation line 111, and a control logic 115. Water heater 200 further includes a thermocouple 117, a mixing valve 121, and an optional water deflection plate 123. Deflection plate 123 may optionally be a flat water deflection plate with side slots allowing a limited volume of water to past through while water on the other side of deflection plate adjacent to the slots is pulled by water passing through slots to create a churning action. This churning action promotes thermal mixing within the tank while reducing areas for biofilm development and reducing bacterial entrapment within water tank 103. Recirculation line 111 exits near a bottom end of water tank 103 and is injected into a bottom end of heating element 205. In other configurations, recirculation line 111 may exit water tank 103 at other different locations.

Mixing valve 121 may be added to the outlet line 109 external to water tank 103 to prevent personnel from being scalded by the high temperature of water exiting the system. Thus, the outlet line 109 may also serve as an inlet to the mixing valve 121. As understood by those of ordinary skill in the art, mixing valve 121 may be a thermostatic mixing valve and may be adjustable. As illustrated, mixing valve 121 further includes a cold water input line 125 and an output line 127. Mixing valve input line 125 is connected to input line 107 with a T-connector and line 129. Hot water from the output line 109 of the water tank 103 is mixed with cool water from the input line 125 and output through output line 127. Thus, mixing valve 121 may act as an anti-scalding valve that facilitates operation of the hot water tank above temperatures that promote bacterial growth, thus the maintaining of sanitary conditions while protecting hot water users from being scalded.

For example, hot water from water tank 103 after being heated above 131° F. (to reduce bacteria growth) enters mixing valve 121 and is mixed with cold water from input line 125 and exits output line 127 at a lower preset temperature for washing hands or beverage preparation. Keeping heated water in water tank 103 above 131° F. may prevent some bacterial growth and use of mixing valve 121 provides water supplied to the lavatories and galleys of a desired temperature between 95° F. to 115° F. to prevent personnel from being scalded. These temperatures may be consistently achieved during the draw and recovery period by the water heater 200 of FIGS. 2 and 3. It should be appreciated that the described temperatures and temperature ranges are one example and that the water tank 103 may be configured to store and supply water at other suitable temperatures and temperature ranges, for example, 125° F.

In other configurations, it may be desirable to heat water in tank 103 to a higher temperature than 131° F. to prevent other bacteria growth and to kill existing bacteria. As hot and cold water enters mixing valve 121, in some configurations, an optional thermostat 131 in mixing valve 121 may sense the outlet water temperature. The thermostat 131 reacts by adjusting the incoming amounts of hot and cold water to maintain a stable output temperature. In some mixing valves, a mechanical adjustment of mixing valve 121 allows one to preset the maximum desired temperature.

Thermocouple 117 may sense temperature within water tank 103 and used by a control logic 115 to monitor and control the water temperature inside water tank 103. The functionality of control logic 115 may be similar to the functionality of control logic 15 of FIG. 1B described above. Similar to the water heater 100 of FIG. 1B, flow-through heating element 205 is located near the bottom of water tank 103. Heating element 205 may be placed in other positions as understood by those of ordinary skill in the art. Heating element 205 is commonly a "flow-through" type of heating assembly because, in some configurations, heating element 205 flows water through its entire length during heating. Warmed water exiting heating element 205 creates a pressure head inside water tank 103 which contributes to the thermodynamic pumping action and thermal mixing of water within water tank 103. As previously mentioned, this enables water heater 200 to maintain a generally uniform water temperature within water tank 103 above a predetermined value to maintain sanitary condition within water tank 103.

Figure 4:
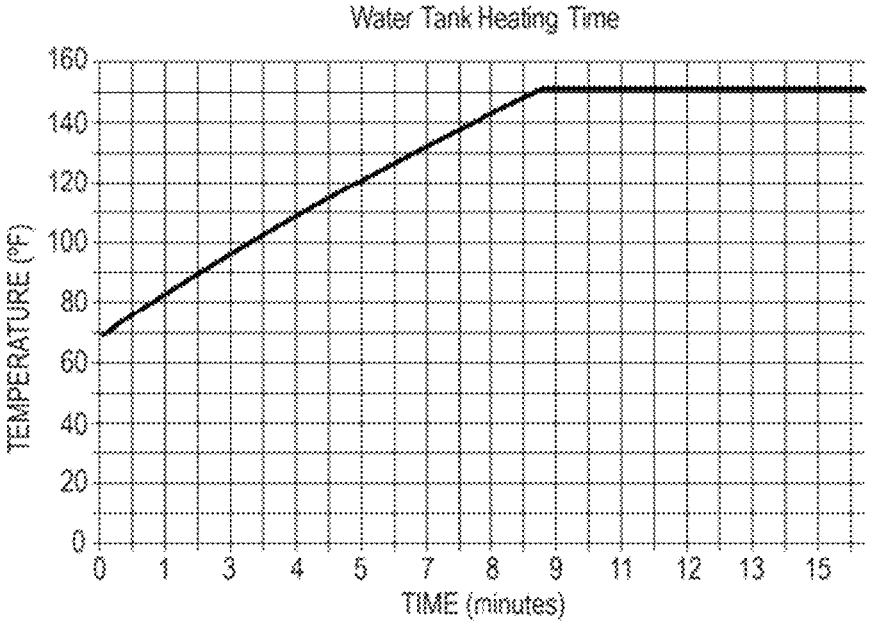
FIG. 4 illustrates the water tank heating time of the third embodiment of a water heater.
Figure 5:
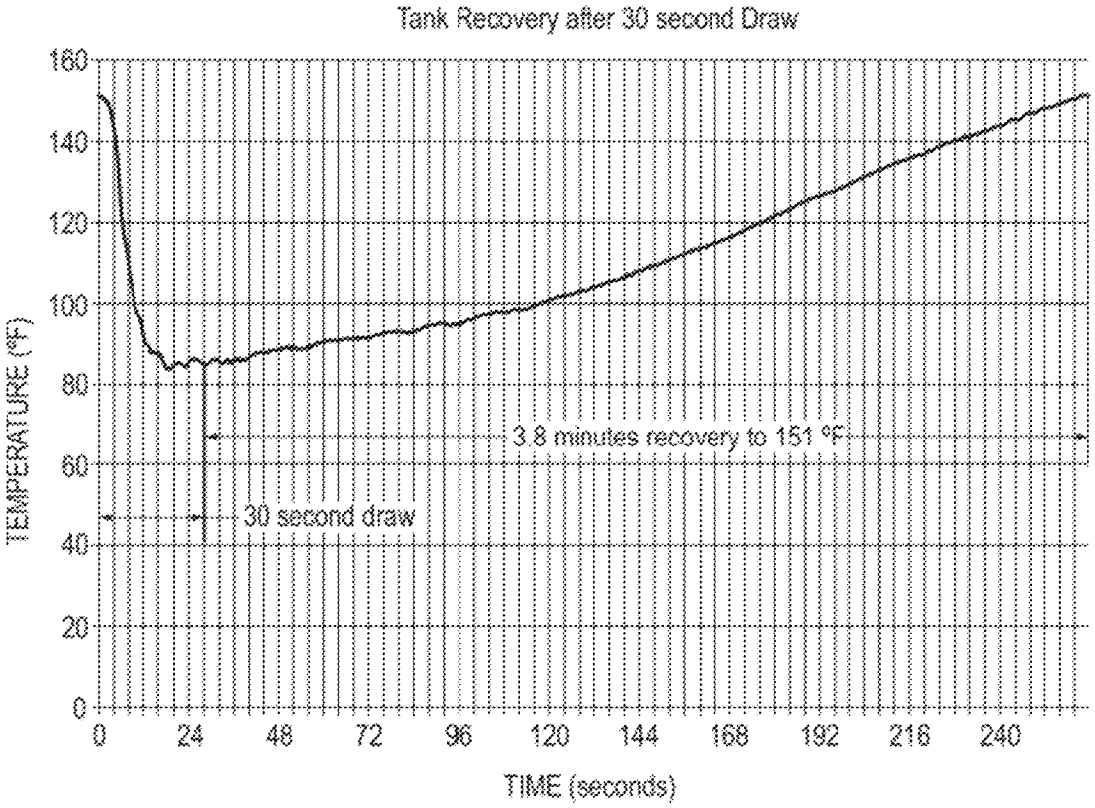
FIG. 5 illustrates the water tank recovery time of the third embodiment of a water heater.

Power to the flow-through water heater 205 is controlled to keep the temperature of water in tank 103 nearly constant during both the draw and idle periods. FIG. 4 is an exemplary graph of the initial heating time of water tank 103 with flow-through heating element 205 powered with 410 watts in one embodiment. FIG. 5 is an exemplary graph of the recovery time of water tank 103 with flow-through heating element 205 powered with 410 watts in this same exemplary embodiment.

Example methods may be better appreciated with reference to flow diagrams. While for purposes of simplicity, explanation of the illustrated methodologies are shown and described as a series of blocks. It is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 6:
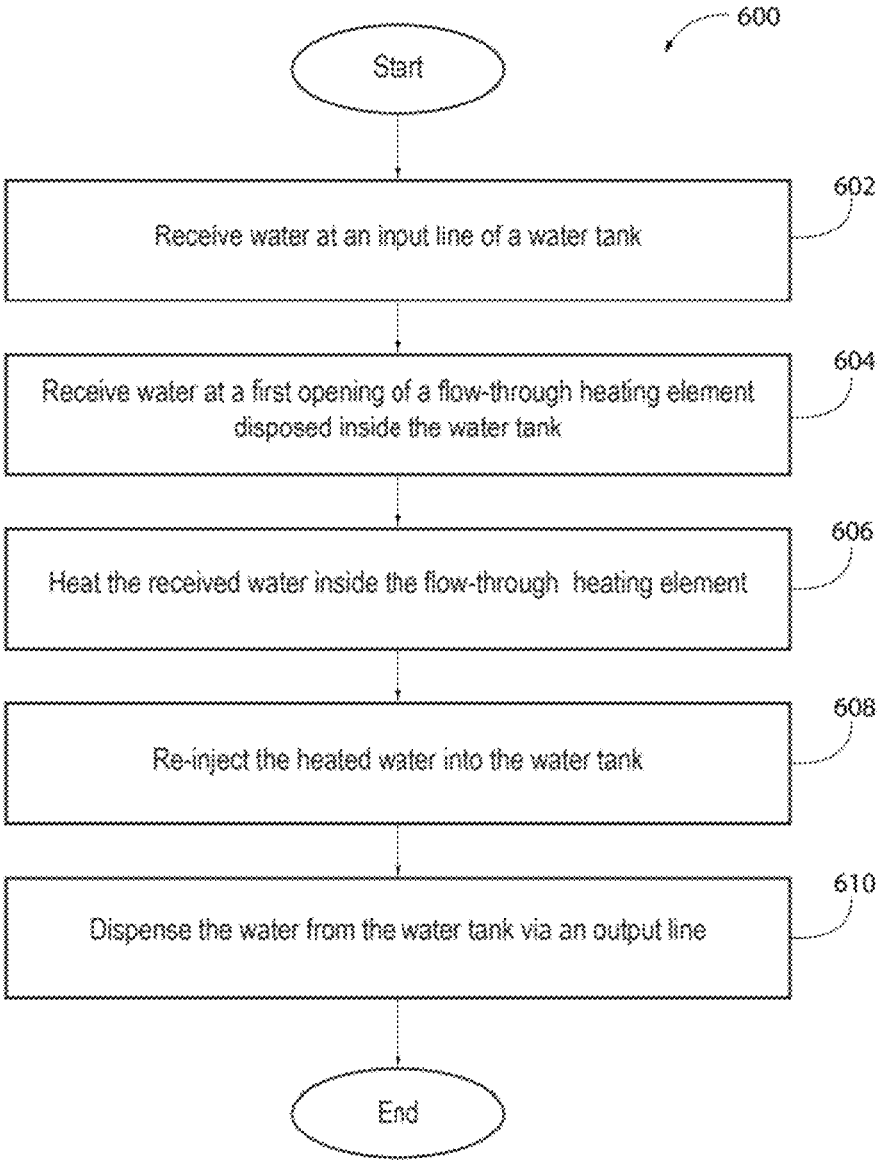
FIG. 6 illustrates another embodiment that is a method of heating water.

FIG. 6 illustrates a method 600 of heating water in a water tank. The method 600 begins by receiving water at an input line of a water tank at 602. In some configurations, a recirculation line may be used to flow water into the heating element as illustrated in FIGS. 1B, 2 and 3 and as discussed above. This recirculated water is then received at a first opening of a flow-through heating element disposed inside the water tank at 604 and heated inside the flow-through element heating element at 606. In one example, the heating element is at least partially located near a bottom portion of the water tank. The heating element may be a flow-through type heating element where water is heated while flowing from an input opening to an output opening of an elongated channel of the heating element. The heated water is the re-injected the heated water into the water tank at 608 and dispensed from the water tank via an output line at 610.

Other embodiments of method 600 may heat water above a temperature to kill bacteria such as Legionella and prevent unwanted biofilms. As discussed above, in other embodiments, method 600 may cool the heated water when it is removed from the tank with a line of cooler water so that it is safe for use. In another embodiment, method 600 may deflect water within the water tank with a deflection plate with openings/slit openings or deflect water in another way to promote thermal mixing of the water.

FIGS. 7-10 illustrate a thermostatic mixing valve that may be utilized in conjunction with embodiments of water heaters described herein. Thermostatic mixing valve may be adjustable and is designed to automatically control the outlet water temperature, subject to user adjustment, to prevent scalding. Thermostatic mixing valve is sometimes subsequently abbreviated as "TMV."

Figure 7A:
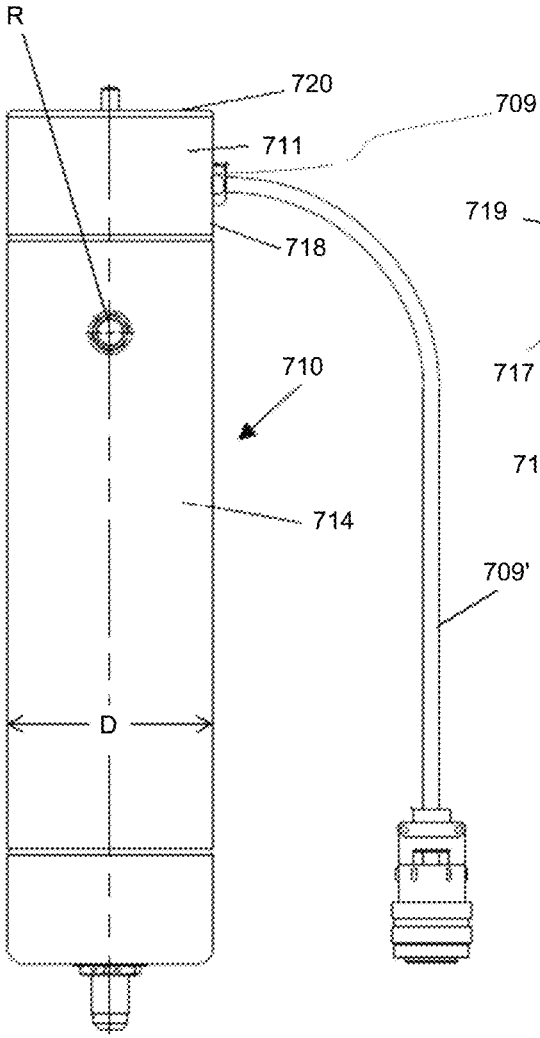
FIG. 7A and FIG. 7B illustrate a side profile view and a side cross-section view, respectively, of an embodiment of the water heater having a thermostatic mixing valve.
Figure 7B:
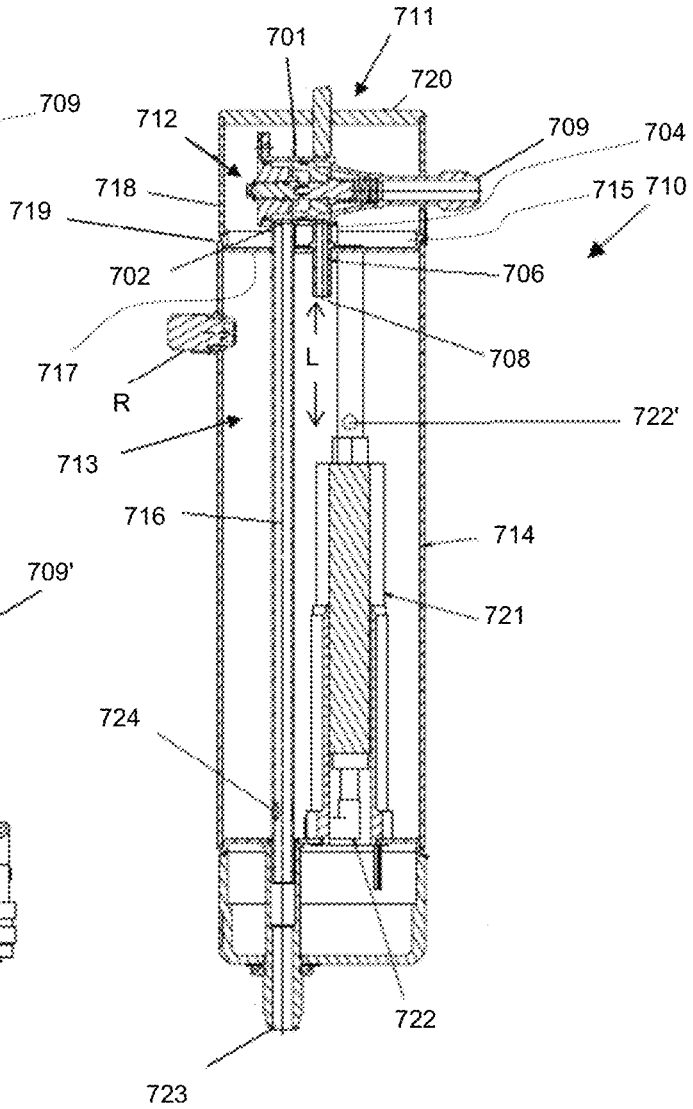

FIG. 7 depicts an exemplary thermostatic mixing valve 700 that is integral with water heater 710. The wetted materials comprising TMV 700 generally comprise materials suitable for potable drinking water systems, such as stainless steel. In this example embodiment, TMV 700 is positioned near the top of water heater 710, and enclosed therein within TMV chamber 712 that is situated on top of the tank 714. In some embodiments, TMV 700 is enclosed within a TMV housing, for example, a stainless steel 360 housing; however, other materials may be utilized that are suitable for potable drinking water systems. In operation, tank 714 is completely filled with water and its inner volume thus defines a water volume. In this example embodiment, TMV chamber 712 comprises side walls 718 and lid 720, where lid 720 may be removable to facilitate maintenance of water heater 710 and/or installation or replacement of TMV 700. In this embodiment, sidewalls 718 are cylindrical and are essentially an extension of tank 714; however, other embodiments may be utilized.

Fluid is generally introduced to thermostatic mixing valve 700 via two (2) passage ways, a cold fluid inlet and a hot fluid inlet, whereas fluid of mixed temperature exits TMV 700 via a fluid outlet. In FIG. 7, the cold fluid inlet, hot fluid inlet, and TMV fluid outlet are represented by numerals 702, 704, and 709, respectively. The cold water inlet 702 of TMV 700 may be connected to a common cold water inlet 716 of water heater 710 as depicted, whereas the warm water inlet 704 of TMV 700 may extend into tank 714, for example, via warm water inlet pipe 706 having warm water inlet 708. FIG. 7 depicts an embodiment where the cold water inlet 702 of TMV 700 connects to a common cold water inlet 716 that runs through the interior of tank 714 and introduces cold water via tank inlet 724; however, the common cold water inlet 716 may be differently oriented with respect to TMV cold water inlet 702 and tank inlet 724. FIG. 7 also depicts warm water inlet 704 of TMV 700 connected to pipe 706 that extends downward into the top of tank 714 so that the inlet 708 of pipe 706 withdraws water near the top of the water column defined by tank 714, as the temperature of water column near the top of tank 714 tends to be warmer than the temperature of water column near the bottom of tank 714.

Locating the thermostatic mixing valve 700 at the top of water heater 710 may provide many benefits. For example, locating TMV 700 at the top of tank 714 such that the inlet 708 of warm water inlet 704 of TMV 700 is a vertical distance "L" from hot water outlet 722 may provide many benefits. Here, the temperature of the water column defined by tank 714 varies within tank 714. Thus, the coolest water in the water column is located near the inlet of tank 714, for example, at tank inlet 724 where cold water is introduced into tank 714, whereas the warmest water in the water column is located near the point at which heated water exits the heating element 721 within tank 714, for example, at hot water outlet 722. In operation, the coolest water at the bottom of the tank and near tank inlet 724 is mixed with warmer (or hot) water at the top of the water column near the top of tank 714, and the temperature differential existing in the water column in turn enhances the dynamic thermal mixing even when water is not being drawn from the tank 714 via inlet 708 that is interconnected to warm water inlet 704 via pipe 706. In the illustrated embodiment, "L" is about two (2) to three (3) times the diameter of tank 714; however, "L" may be other lengths, for example, at least two (2) times the diameter of tank 714.

The utilization of a common cold water inlet 716 so that it introduces water into tank 714 via tank inlet 724 and introduces cold water into TMV 700 via cold water inlet 702 may provide additional benefits. For example, this orientation may minimize the pressure differential to which TMV 700 is exposed when mixing the hot and cold water flow streams. Large pressure differences between the tank inlet 724 and TMV warm water inlet 704 may cause temperature spikes at the outlet. Positioning the thermostatic mixing valve 700 and its mixed temperature water outlet 709 at the top of the tank 714 keeps its components pre-heated to a point where most of the heat energy from the water column is transferred to the thermostatic actuator that responds to changes in temperature. The thermostatic actuator is more fully discussed below.

Figure 8A:
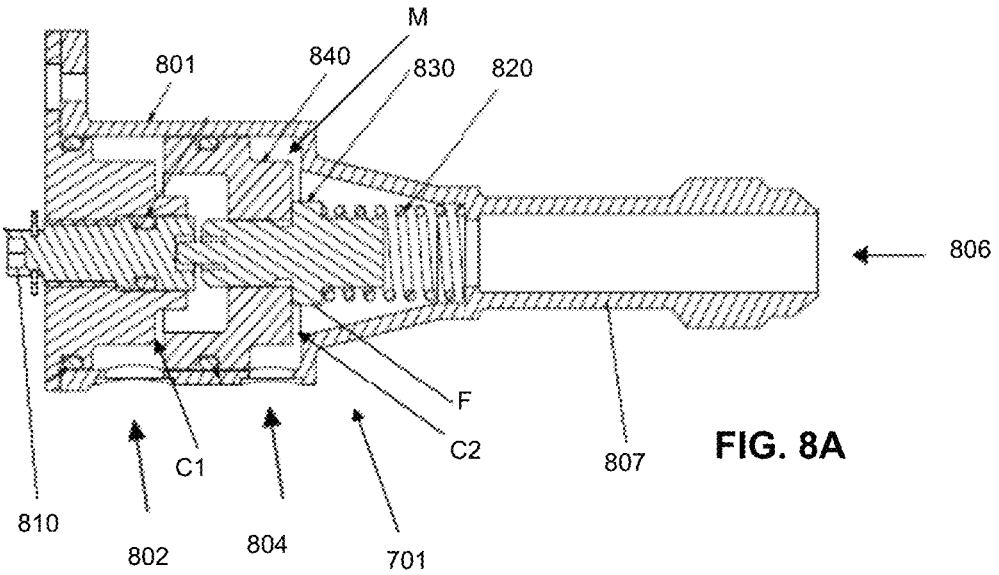
FIGS. 8A-8D illustrate various cross-section views of a first embodiment of a thermostatic mixing valve.
Figure 8B:
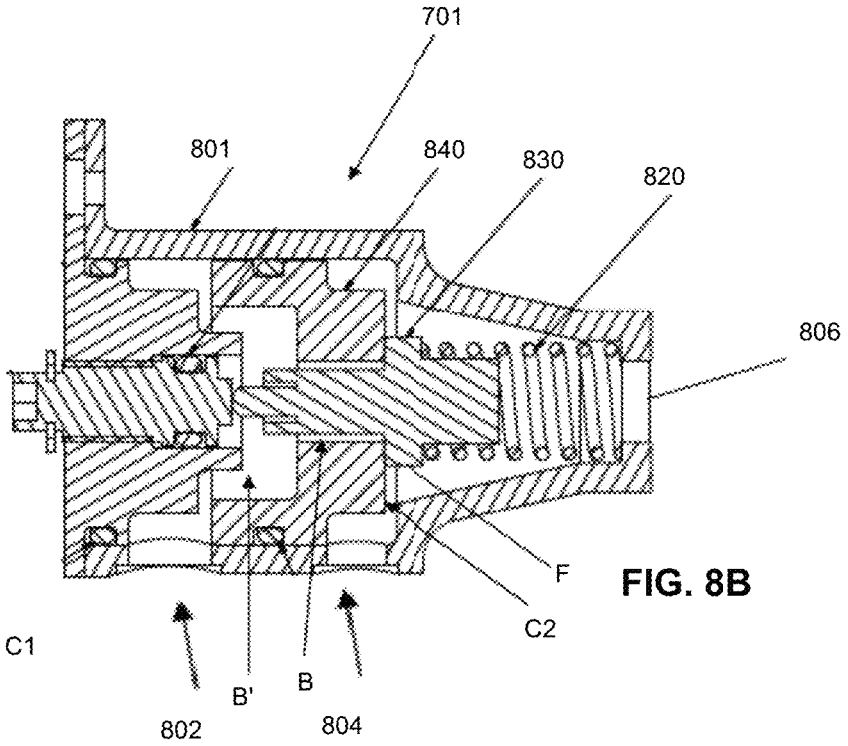
Figure 8C:
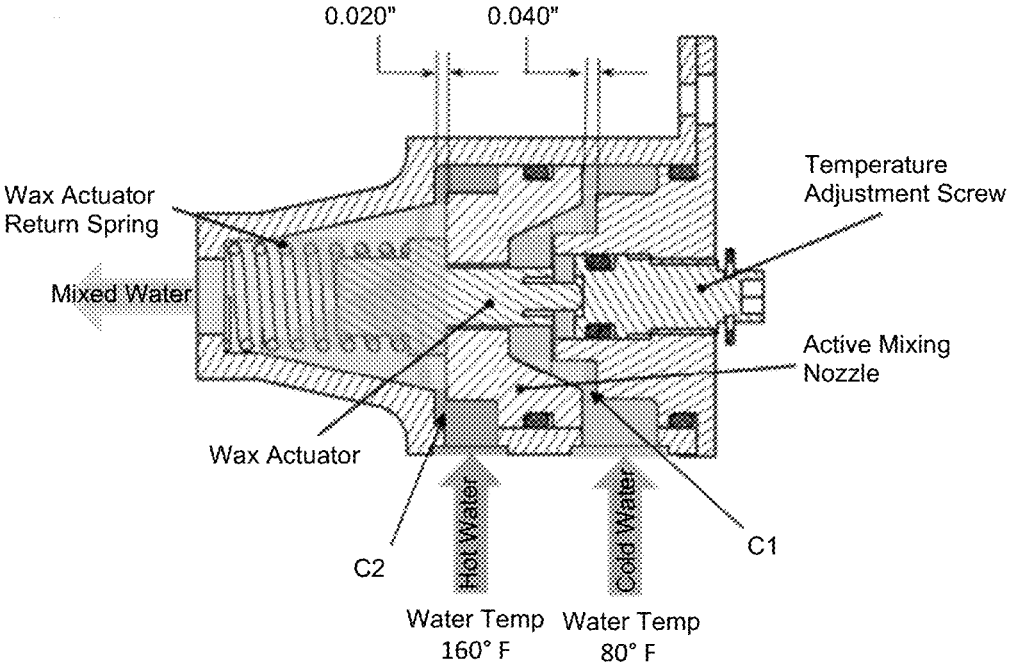
Figure 8D:
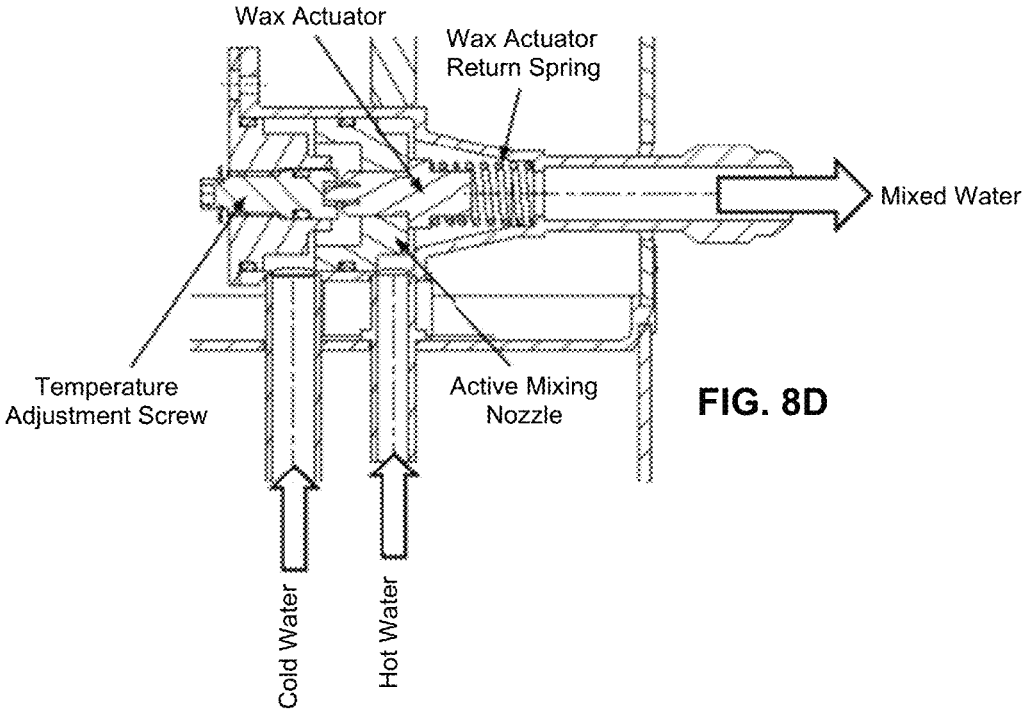

FIGS. 8A, 8B, 8C, and 8D illustrate an exemplary thermostatic mixing valve 800 having cold water inlet 802, warm water inlet 804, and mixed temperature water outlet 806. FIGS. 8A and 8D depict water outlet 806 of TMV valve 800 having an extension 807 installed thereon so as to allow water outlet 806 to extend beyond the structure defining the TMV chamber. Moreover, FIG. 8D depicts cold water inlet 802 and warm water inlet 804 of TMV 800 being fitted with common water inlet 716 and warm water extension pipe 706, respectively, whereas such TMZ water inlet fittings or extensions are not depicted in either FIG. 8A or 8C. In this example embodiment, thermostatic mixing valve 800 generally comprises (i) a temperature adjustment screw 810, (ii) an actuator spring 820, (iii) a thermal actuator 830, and (iv) an active mixing valve 840.

Temperature adjustment screw 810 may be utilized to set the desired temperature or ratio of warm and cold mixed water flow exiting water outlet 806, and TMV 800 operates to ensure steady temperature of water flow exiting TMV outlet 806. For example, adjustment screw 810 may be rotated clockwise or counterclockwise, which in turn displaces active mixing valve 840 within the housing 801*v* of TMV 800, and the displacement of active mixing valve 840 within the housing 801 of TMV 800 affects the amount of flow entering cold water and warm water inlets 802, 804. For example, rotating adjustment screw 810 counterclockwise all the way until it no longer rotates would displace active mixing valve 840 to a location where cold water inlet 802 is almost completely blocked so that mostly warm water enters TMV 800 via warm water inlet 804 and a small amount of cold water enters cold water inlet 802, and the water flow exiting outlet 806 comprises a steady flow of the desired pre-set mixture of mostly warm water. In most embodiments, cold water is always being mixed with the hot water to lower the TMV outlet 806 fluid temperature. Alternatively, rotating adjustment screw 810 clockwise all the way until it no longer rotates would displace active mixing valve 840 to a location where the warm water inlet 804 is completely blocked so that only cold water enters TMV 800 via cold water inlet 802, and the water flow exiting outlet 806 comprises a steady flow of the desired mixture of only cold water. Furthermore, adjustment screw 810 may be adjusted or screwed to any number of rotational orientations between those two extremes, which in turn positions active mixing valve 840 to locations between cold and warm water inlets 802,804, so that both warm and cold water are entering TMV 800 and the water flow exiting outlet 806 comprises some desired ratio of warm and cold water. Thus, a user may adjust adjustment screw 810 to fine tune the ratio of warm and cold water exiting TMV 800 via outlet 806.

Adjustment screw 820 operates as a biasing member and may be any type of screw known in the art. In one embodiment, adjustment screw 820 comprises a 316 stainless steel set screw; however, adjustment screw 820 may be comprised of other materials suitable for potable drinking water systems.

Actuator spring 820 receives one end of the thermal actuator 830 so as to position, bias and/or return the thermal actuator 830 into an equilibrium position in response to a user engaging the adjustment screw 810. Actuator spring 820 may comprise any number of materials that are suitable with potable water drinking systems. In one example, actuator spring 820 comprises a 17-7 pH stainless steel return spring; however, alternatives may be utilized.

Thermal actuator 830 is disposed within the housing 801 of TMV 800. In the illustrated embodiments, thermal actuator comprises a wax actuator; however, other actuators may be utilized such as, for example a shape memory alloy or a MEMS thermal actuator. FIG. 9 depicts an exemplary thermal actuator 900 that utilizes wax as the expansion material. In this example, thermal actuator 830 is a wax actuator 900 that comprises (i) a hollow actuator guide 902 that is cupped or flanged at one end; (ii) a piston 904 extending therethrough and having an end that exits guide 902 at the other non-cupped/flanged end of guide 902; (iii) a diaphragm assembly 906 attached to a second end of piston 906 within guide 902, and extending within guide 902 to the cupped/flanged end of guide 902; and (iv) an expansion compartment 908 attached to the cupped/flanged face of guide 902, and containing an expansion material 910 therein. In the illustrated embodiment, the expansion compartment 908 is nested within the adjustment spring 820 and, when the expansion compartment 908 and expansion material therein 910 (which is wax in the illustrated embodiment) are exposed to warm temperatures, the expansion material 910 expands which in turn displaces diaphragm assembly 906, piston 904 attached thereto, and active mixing nozzle 840 so as close warm water inlet 804 and thus affect (i.e., decrease) the amount of warm water entering TMV 800 via warm water inlet 804. Moreover, piston 904 extends beyond the non-cupped/flanged end of guide 902 so as to interact with adjustment screw 810, so that a user can adjust the maximum displacement of active mixing nozzle 840 within TMV 800. In this embodiment, the external components of thermal actuator are comprised of an alloy, for example, a copper allow C90300, however, other materials may be utilized that are suitable for potable drinking water systems.

Figure 10B:
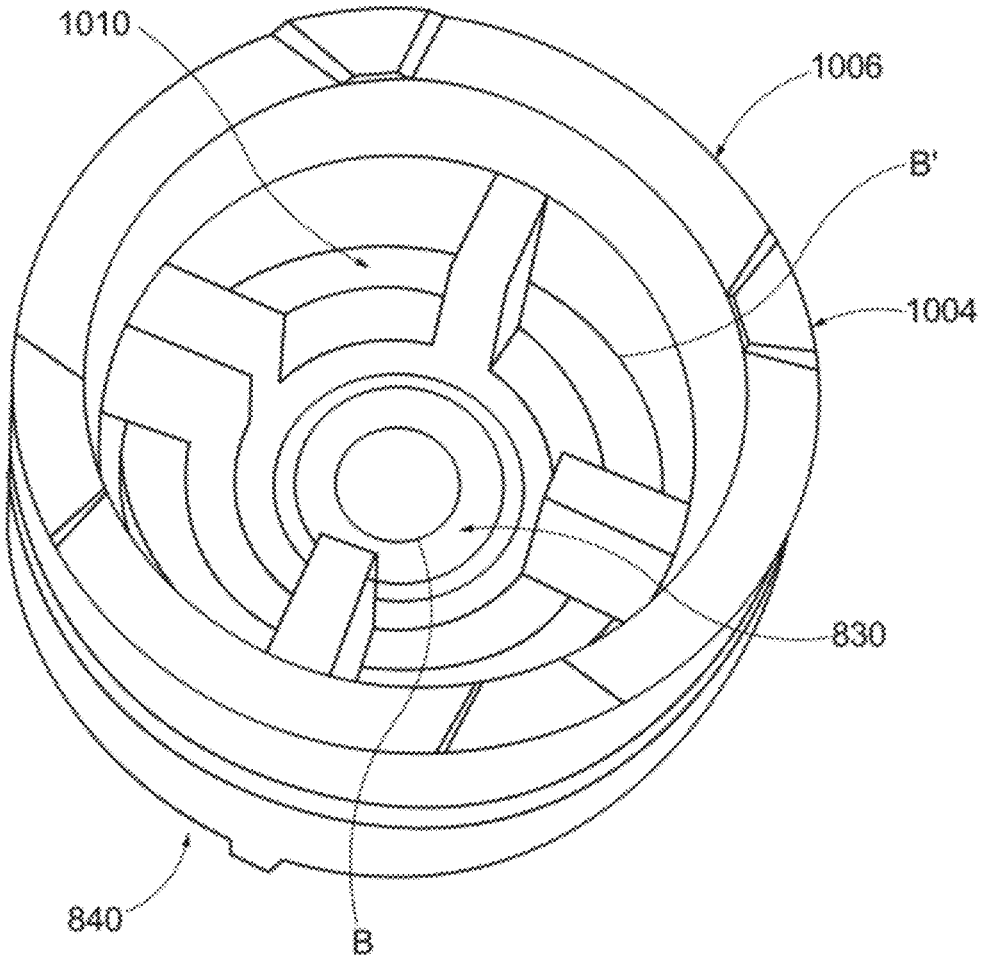

Hot water is always being drawn into the thermostatic mixing valve from the top of the water column where the water temperature is the highest and then mixed with pre-heated cold water within the active mixing valve of the TMV. FIG. 10 depicts an exemplary active mixing nozzle 840. In the illustrated embodiment, active mixing nozzle has four (4) machined slots (i.e., 1002*a*, 1002*b*, 1002*c*, and 1002*d*) on the cold water side 1004. In one embodiment, slots 1002*a*-1002*d* are spaced 90 degrees apart; however, other special arrangement may be utilized other than 90 degrees and, moreover, more or less slots may be utilized at other orientations. Nevertheless, the depicted configuration reduces the thermal spikes that are known to occur. The slots 902*a*-902*d* also insure that there is a minimum amount of cold water flow to reduce the maximum hot water temperature at the outlet 806 of the thermostatic mixing valve 800 to a safe level. In the illustrated embodiments, the active mixing nozzle 840 is mostly directing the cold water flow to be mixed with the hot, and much of the mixing of warm and cold water streams occurs near the end of the thermal actuator that contains the thermal expansion material. In one embodiment, active mixing nozzle 840 comprises Polytetrafluoroethylene (PTFE); however, other materials may be utilized that are suitable for potable drinking water systems.

As mentioned above, positioning the thermostatic mixing valve and its mixed temperature water outlet at the top of the tank (e.g., tank 714) keeps the TMV 800 components pre-heated to a point where most of the heat energy from the water column is transferred to the thermostatic actuator that responds to changes in temperature. This enhances the system's overall efficiency. For example, in the embodiment where thermal actuator 830 is a wax actuator, thermal expansion of the wax inside of the thermal actuator 830 moves the active mixing nozzle 840 to a position where the desired pre-set ratio of hot and cold water mix is achieved at the mixed water temperature outlet 806 of the TMV.

The foregoing embodiments disclose utilization of various heating elements. FIGS. 11-14 illustrate an example of an alternate embodiment of a heater or heating assembly that may be used with any of the previously disclosed hot water systems. In these embodiments, the heater is configured as a thermosiphon, and operates on the principal that cold water has a higher specific density than warm water and that the cold water, being heavier than the warm water, will sink to the bottom (e.g., of a water tank). For purposes of this disclosure, these thermosiphon heating assemblies are sometimes hereinafter referred to as the "heater," the "flow through heater," or the "thermosiphon."

Figure 11B:
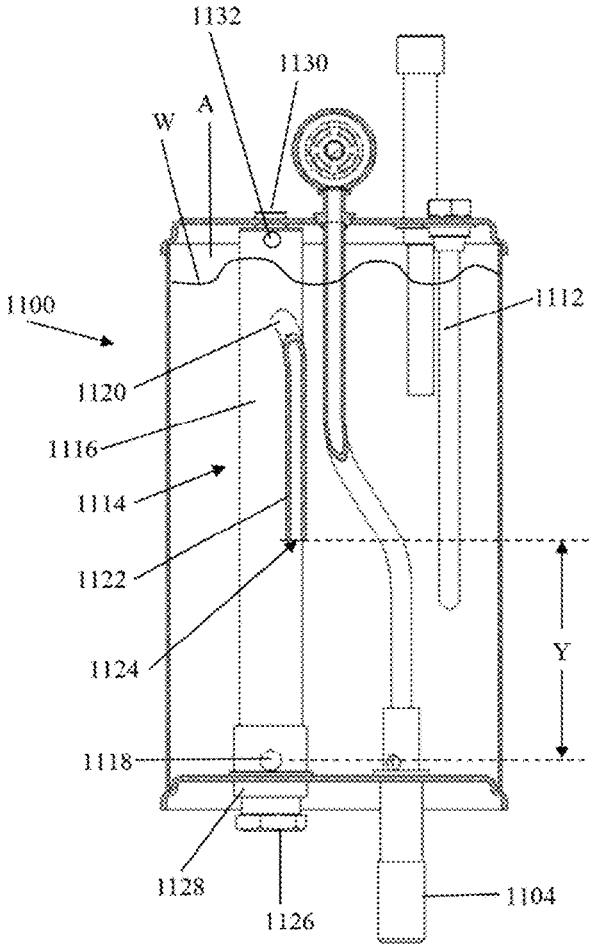
FIG. 11B illustrates a side cross-section view of the water heating system of FIG. 11A along line B-B.
Figure 11A:
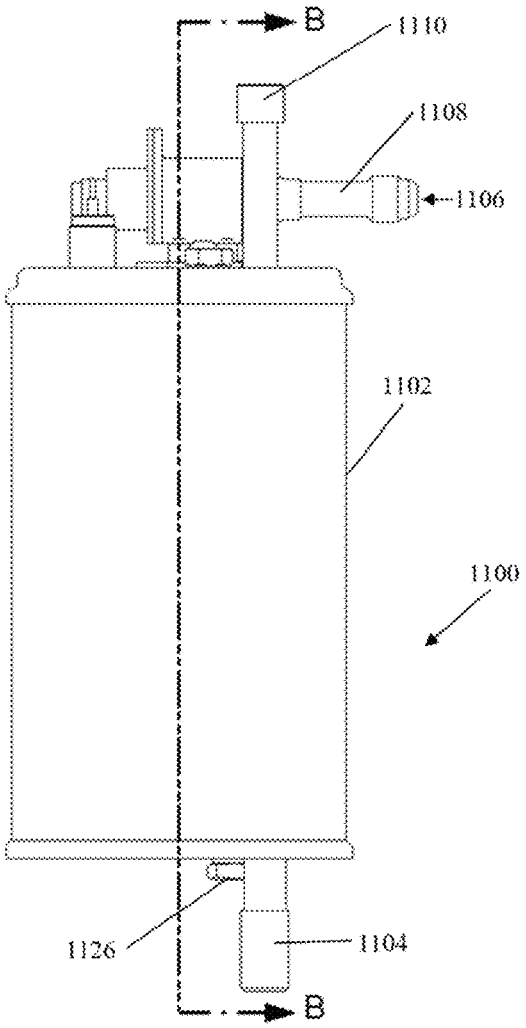
FIG. 11A illustrates a side profile view of an exemplary water heating system having a flow through heating device that may incorporate the principles of the present disclosure.
Figure 12:
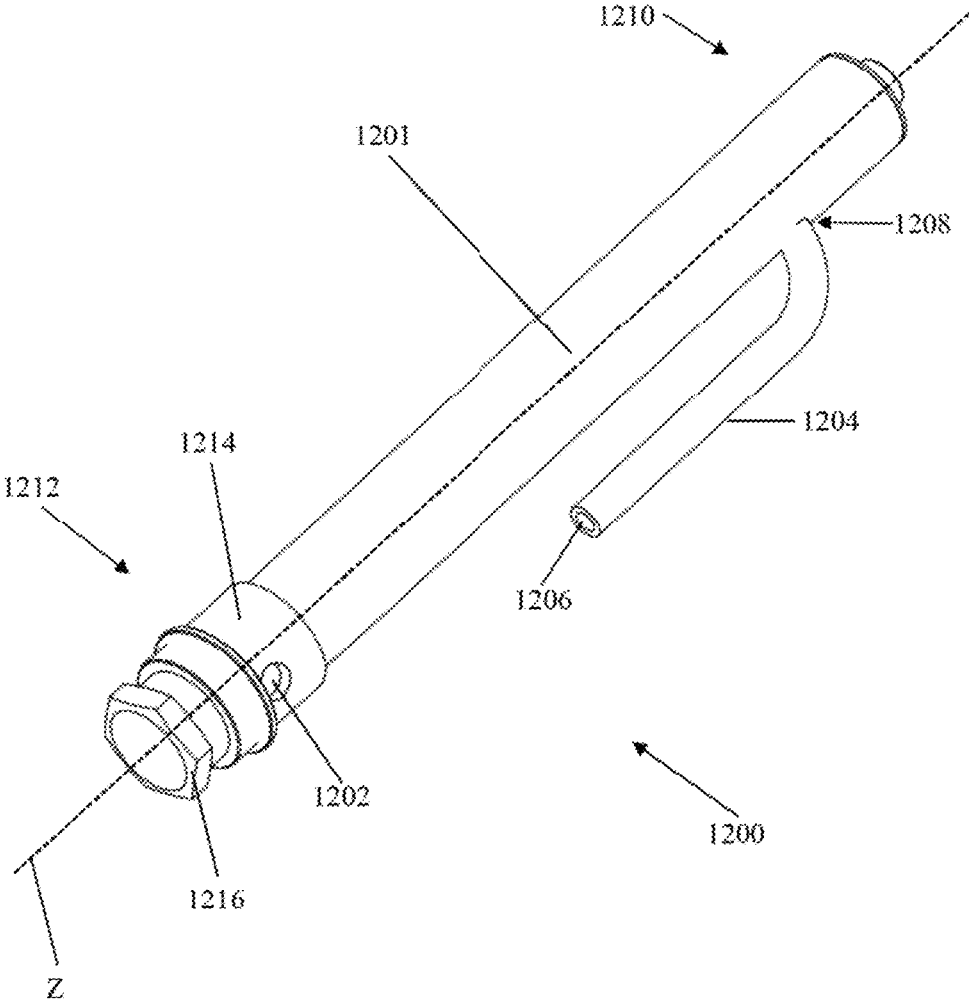
FIG. 12 illustrates an isometric view of the flow through heating device utilized in the embodiment illustrated in FIGS. 11A-11B.
Figure 13B:
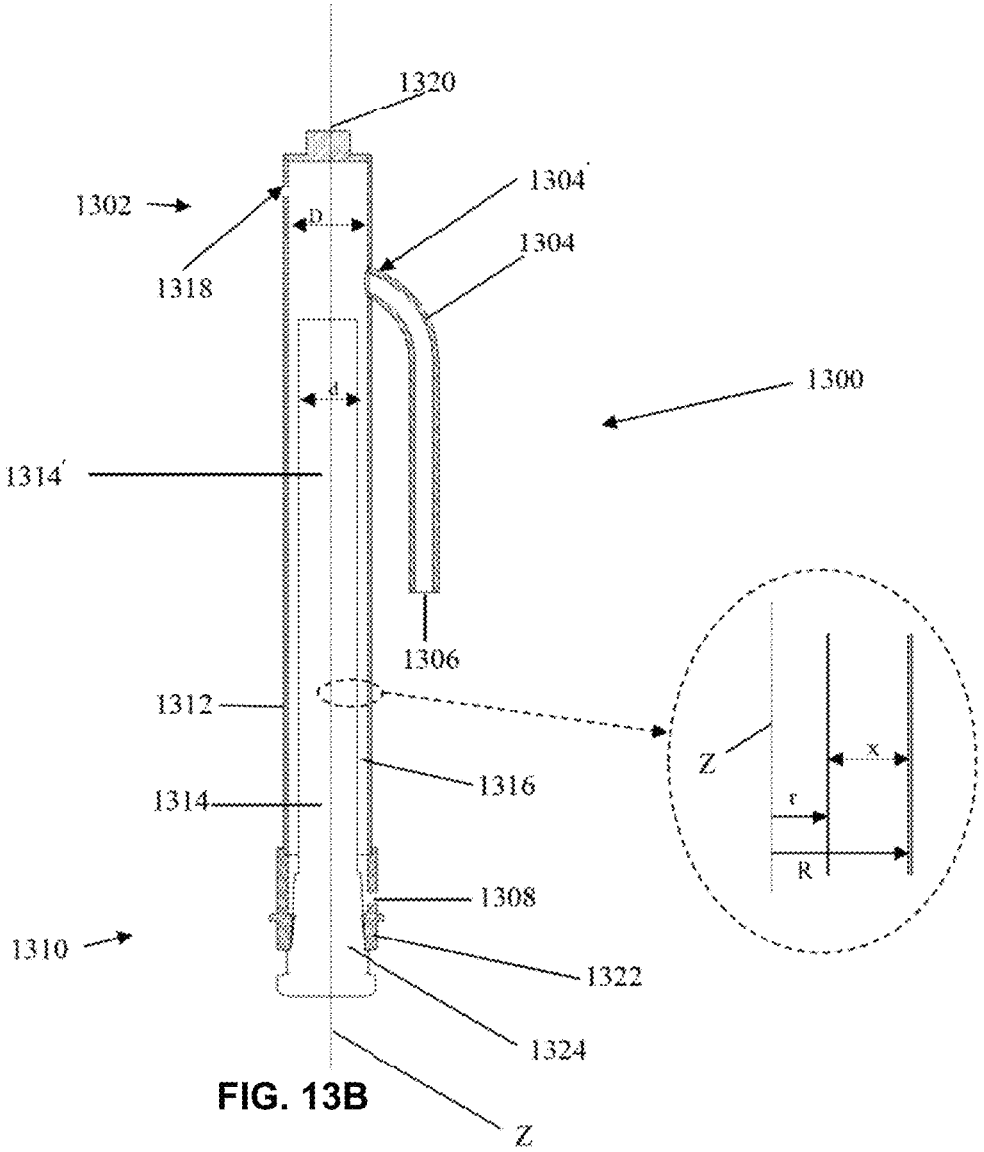
FIG. 13B illustrates a side cross-section view of the flow through heating device of FIG. 13A along line A-A.

FIGS. 11A-11B illustrate an exemplary hot water system 1100 that may incorporate aspects of the present disclosure, according to one or more embodiments. FIG. 12 illustrates a flow through heater 1200 that may be incorporated into the foregoing hot water system 1100, and FIG. 13*b* illustrates a cross-sectional view of the same. As illustrated, the flow through heater generally includes an outer tube and a heating element. The heating element is smaller than the outer tube such that the heating element may be installed within the outer tube as hereinafter described.

In one or more embodiments, the heating element of the flow through heater includes a diameter "d" as measured across an outer surface of the heating element (and a radius "r" that equals "d/2") and the outer tube has larger diameter "D" as measured across an inner surface of the outer tube (and a larger radius "R" that equals "D/2"). The outer tube (i.e., the housing) encloses or houses the heating element, such that a cavity is formed or defined by the space between the outer surface of the heating element and the inner surface of the outer tube, so that the heating element may concentrate its energy (i.e., heat) into the volume of the cavity; and this concentration of heat within the cavity may cause the fluid therein to circulate therethrough with thermal mixing properties. The cavity formed between the outer tube and the heating element includes a width or ring width "x." In the illustrated embodiments, the cavity is an annular ring shaped cavity due to the contours of the outer surface of the heating element and the inner surface of the outer tube.

Depending on the properties of the outer tube, the heat generated by the heating element may transfer through the outer tube, exterior to the flow through heater, and into a larger volume of fluid, for example, of a water tank in which the flow through heater is installed, which may serve to preheat fluid of the larger volume before being drawn into the flow through heater. In some embodiments, the heating element of the flow through heater and the outer tube are elongated. In the illustrated embodiment, for example, the heating element and the outer tube in which it is inserted are arranged as elongated cylinders, which in turn result in the annular or ring shaped cavity. In other embodiments, however, the heating element and the outer tube may have different geometries, which may or may not have uniform width and/or cross-section along their length dimension, and in those embodiments, the shape of the cavity formed between the heating element and the outer tube will depend on the contours of the outer surface of the heating element and the inner surface of the outer tube.

The ring width x may vary depending on the particular application. In some embodiments, the ring width x is uniform along the length that the heating element extends within the outer tube, whereas in other embodiments, the ring width x varies (i.e., increases and/or decreases) along the length as the heating element extends within the outer tube due to, for example, the contour of either or both of the inner surface of the outer tube and the outer surface of the heating element. In some embodiments, the ring width x is greater than or equal to one (1) mm and less than or equal to twice the diameter d of the heating element (i.e., $1\ mm \leq x \leq 2d$). One such flow through heater having a 420 Watt heating element was tested in a tank holding 0.71 liters of water, and it was determined that the mean heat energy transferred from that 420 Watt heating element was amplified by a factor of approximately 2.5 compared to standard heating devices, and that enhanced heat transfer significantly reduced the amount of time needed to heat the 0.71 liters of water to 85 degrees Celsius by approximately 60%. Nevertheless, it will be appreciated that the annular cavity may be differently configured, for example, with different ring widths x. In even other embodiments, the surface of heating element is configured with screw type baffles, bellows convolutions, etc., which may increase the rate of flow through the flow through heater (e.g., by a factor of 2) as compared to a standard heating device, but still provide the enhanced thermal efficiencies. Moreover, it will be appreciated that the thermal efficiency may be even further enhanced by using heating elements with larger Watt densities and/or using outer tubes constructed from materials that have high thermal conductivity.

Various types of heating elements may be utilized, for example, cartridge heaters like those provided by Watlow and/or Durex Industries. In one example, the heating element is a Watlow FIREROD® Cartridge Heater such as the G6A80 model; in other embodiments, the heating element is a Durex Industries Rapid Fire™ heater, such as an Aluminum Nitride ceramic heater; whereas, in other embodiments a Durex Industries ⅛ Inch Magnum™ Cartridge Heater. The outer tube may comprise any number of materials, and such materials may be of any type of "grade," for example, the outer tube material may be of a Food, Agriculture and Pharmaceutical Grade, etc., and the tube material may generally comprise a material that inhibits growth of biofilms and bacteria. Additionally, the outer tube may be comprised of a material having a high thermal conductivity, which will permit the heat to be more efficiently transferred through such an outer tube to further heat the larger volume of fluid in the tank as compared to tube materials with lower thermal conductivity. Accordingly, the outer tube is comprised of Tellurium Copper in one embodiment, whereas it is comprised of stainless steel in another embodiment; however, various other materials may be utilized, including commonly used plumbing materials like copper, chlorinated polyvinyl chloride (CPVC), polyvinyl chloride (PVC), and crosslinked polyethylene (PEX); or other materials such as aluminum, titanium, etc.

FIGS. 11A-11B illustrate an example hot water system 1100 that may incorporate aspects of the present disclosure, according to one or more embodiments. Here, the hot water system 1100 includes a tank 1102 that may be filled with fluid (e.g., water) up to a water level W, an inlet 1104, an outlet 1106 that may be arranged on a thermal mixing valve 1108 or elsewhere on the hot water system 1000, and one or more pressure relief valves 1110. In the illustrated embodiment, the tank 1102 is filled with fluid up to the water level W, and an air gap A is thus defined at an upper end of the tank's 1102 internal volume. The hot water system 1100 includes a flow through heater 1114 with an air vent 1132 is disposed thereon, above the water line W, such that the air vent 1132 opens into the air gap A as hereinafter described. Also illustrated is an adaptor 1126 at the base of flow through heater 1114 that engages with and extends from a mating adaptor sleeve 1128 configured into the base of the tank 1102, where the adapter 1126 and the adapter sleeve 1128 facilitate field maintenance as discussed below.

FIG. 11B is a cross section of hot water system 1100 along line B-B in FIG. 11A, and illustrates an exemplary arrangement of the flow through heater 1114, as well as other internal components such as a thermocouple 1112, within the tank 1102 of the hot water system 1100. As illustrated, the flow through heater 1114 includes having a fitting 1130 that is designed to be received in a mating recess of the tank 1102. Here, the fitting 1130 is received in a lid of the tank 1102 so as to secure flow through heater 1114 therein. Accordingly, in this example embodiment, the flow through heater 1114 is secured within tank 1102 at the top thereof via the fitting 1130, and is also secured at the bottom of tank 1102 via interaction of the adapter 1126 and the mating adaptor sleeve 1128. In other embodiments, however, the flow through heater 1114 may be differently oriented and/or secured relative to the tank 1102.

Figure 14:
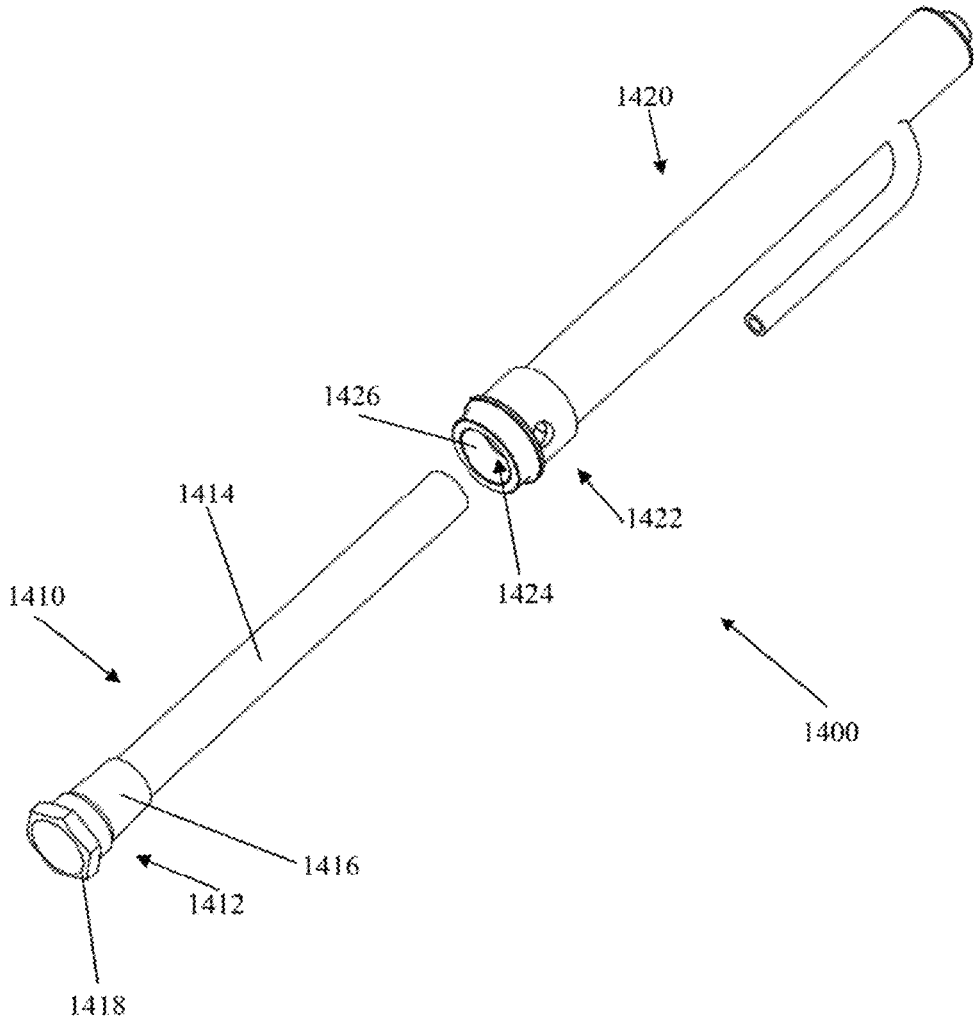
FIG. 14 illustrates an exploded isometric view of the flow through heating device of FIG. 12.

As illustrated, the flow through heater 1114 includes an outer tube 1116 that encapsulates or houses a heating element (obscured, see FIGS. 13*b* and 14). The flow through heater 1114 also includes a water inlet orifice 1118 (sometimes referred to as the "inlet") at a bottom end of the outer tube 1116, and a water outlet orifice 1120 (sometimes referred to as the "outlet") near a top end of the outer tube 1116. Here, the outlet orifice 1120 is an opening located on a periphery of the outer tube 1116 and is fitted with an outlet tube 1122 that directs fluid exiting the outlet orifice 1120 according to the dimensions and design of the outlet tube. The outlet tube 1122 may redirect fluid exiting the outlet orifice 1120 to flow through the outlet tube 1122 and exit a tube outlet 1125 thereof that is spaced away from the outlet orifice 1120 and also spaced away from the inlet orifice 1118 by a distance "Y" Here, the outlet tube 1122 is configured to deposit fluid (that is heated by the heating element within the outer tube 1116) at a location within the hot water tank 1102 via the tube outlet 1124 that is located approximately a mid-way between the fluid inlet orifice 1118 and the outlet orifice 1120, such that the distance Y is approximately equal to the distance between the outlet orifice 1120 and the tube outlet 1124. Accordingly, fluid flows into and through the outer tube 1116, and then exits the outlet orifice 1120 of the outer tube 1116, and then flows through outlet tube 1122 to exit the tube outlet 1124 at a location that vertically spaced from inlet orifice 1118 by the distance Y. However, the spacing between the inlet orifice 1118, the outlet orifice 1120, and/or the tube outlet 1124 may be differently spaced relative to each other, without departing form the present disclosure.

It will be appreciated that locating the inlet orifice 1118 at (or near) the bottom of the internal volume of the tank 1102 not only ensures that the flow through heater 1114 draws fluid therein from cooler regions of the tank 1102, but may further enhance thermal mixing properties of the flow through heater 1114. For example, locating the inlet orifice 1118 proximate a bottom region of the internal volume of the tank 1102 may permit formation of a taller water column within the flow through heater 1114 (as compared to locating the inlet orifice 1118 at a higher location), where taller water columns in turn generate a larger pressure head, and a larger pressure head generally enhances buoyant thermal forces (i.e., thermal mixing). And, in some embodiments, the inlet orifice 1118 has a size that depends on the size of the cavity between the outer tube 1116 and the heating element arranged therein, for example, the inlet orifice 1118 may be dimensioned to be larger or smaller than the ring width x of the cavity. In the illustrated embodiment, the inlet orifice 1118 is a circular opening with a diameter that is less than or equal to two (2) times the ring width x of the cavity (i.e., the inlet orifice 1118 diameter≤2×). In other embodiments, the size of the inlet orifice 1118 depends on a cross-sectional area of the cavity, for example, the cross-sectional area of the inlet orifice 1118 may be less than or equal to twice the cross-sectional area of the cavity defined by the ring width x (e.g., (area of the inlet orifice 1118)≤(area of cavity)*2). In other embodiments, however, the inlet orifice 1118 is differently designed. Moreover, the size of the inlet orifice 1118 may be related to the distance Y between tube outlet 1124 and the inlet orifice 1118. For example, the distance Y may be at least three (3) times the diameter of inlet orifice 1118 (e.g., Y≥(inlet orifice 1118 diameter)*3); however, in other embodiments, the distance Y may be lesser than or greater than a different multiple of the diameter of the inlet orifice 1118.

Figure 15:
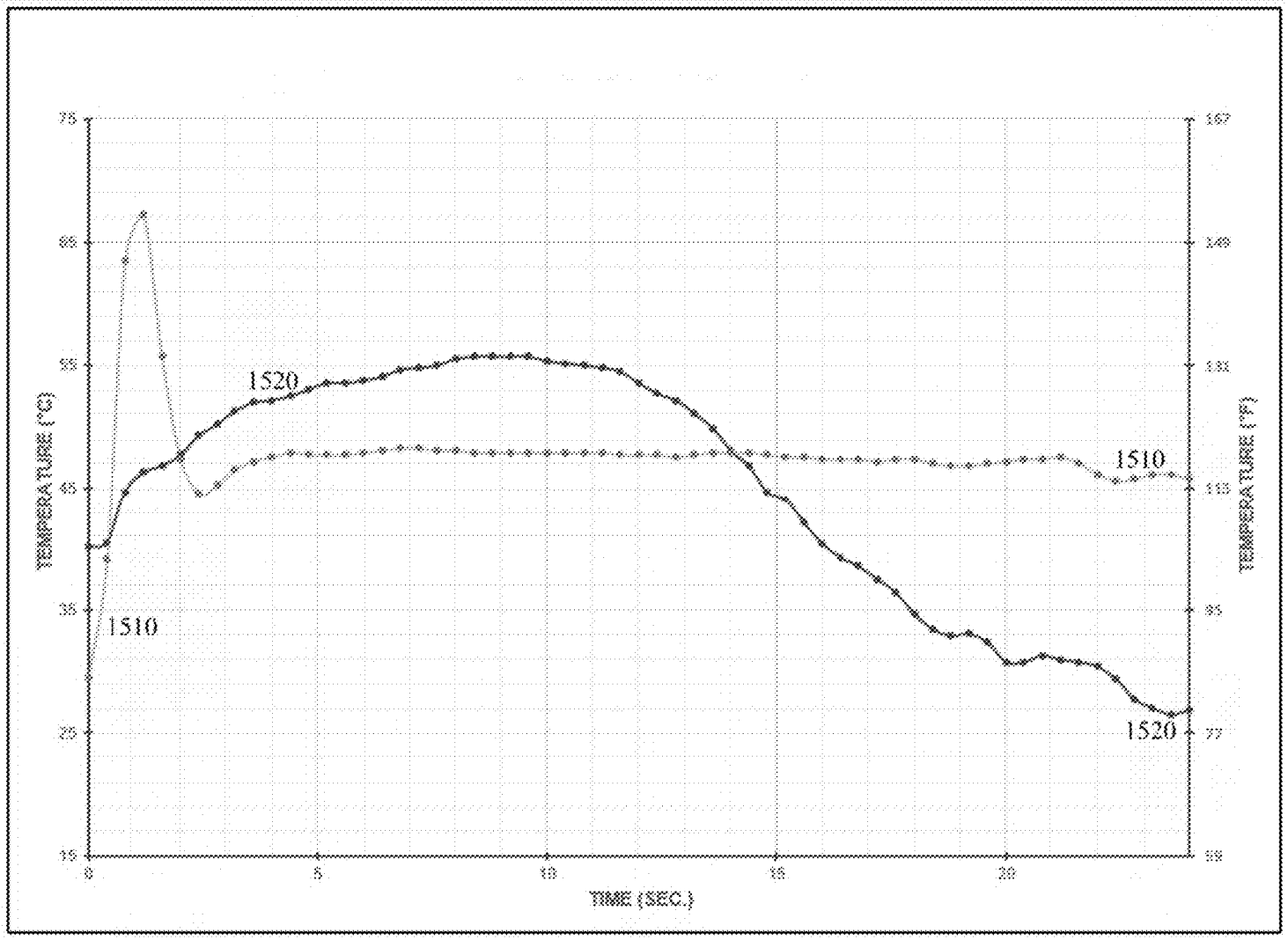
FIG. 15 is a chart showing the outlet temperature over time of the water heating system of FIGS. 11A-11B that utilizes the flow through heating device of FIG. 12.

These configurations of the flow through heater 1114 provide numerous advantages compared to prior art heating devices. For example, in such an arrangement the water W in the tank 1102 is quickly brought up to the desired temperature efficiently while extending the hot water draw time for lavatory or galley hot water usage as illustrated in FIG. 15. Further, such heating devices may be modular so as to, for example, facilitate installation and/or repair. Moreover, these flow through heaters 1114 may provide increased efficiency as compared to prior art heating devices, for example, by consuming less power.

FIG. 12 depicts an isometric view of a flow through heater 1200, which is similarly configured to the flow through heater 1114 of FIG. 11, according to one or more embodiments. Here, the flow through heater 1200 includes a body or outer tube 1201 having an upper end 1210 and a lower end 1212. In the illustrated embodiment, the outer tube 1201 is an elongated cylinder having a length as measure along a central axis Z and a width as measured radially from the central axis Z; however, other geometries may be utilized without departing from the present disclosure. Here, the flow through heater 1200 is configured as a thermosiphonic circulation heater having an inlet orifice or inlet 1202 towards the lower end 1212 and an outlet tube 1204 extending from the outer tube 1201 and having an outlet orifice or outlet 1206. In this embodiment, the outlet tube 1204 laterally protrudes from the outer tube 1201 at a location 1208 near the upper end 1210 of heating assembly 1200, and then extends downwards towards the inlet orifice 1202. Utilization of the outlet tube 1204 allows warmer fluid that accumulates within the internal volume of the outer tube 1201 at the top end 1210 thereof to be deposited at a desired location within a hot water tank (e.g., the tank 1102) that may or may not be oriented proximate to the top end 1210 of the outer tube 1201. It will be appreciated, however, that the outlet tube 1204 and its orifice 1206 may be differently disposed and/or oriented with respect to the inlet orifice 1202 and/or the hot water tank (not illustrated) depending on the specific end use.

Also in this embodiment, the inlet orifice 1202 is disposed on an adapter sleeve 1214 that is coaxially disposed on the lower end 1212 of the outer tube 1201 and configured to attach to a hot water tank (e.g., the tank 1102 in FIGS. 11A-11B). Thus, the outer tube 1201 may be secured within a hot water tank via the adapter sleeve 1214. In addition, the adapter sleeve 1214 may be configured to receive a mating adapter 1216 that may be removable attached to the adapter sleeve 1214. Here, the internal heating components of the flow through heater 1200 are secured to the mating adapter 1216 such that they may be removed and replaced from the outer tube 1201 when the outer tube 1201 is secured within a tank via the adapter sleeve 1214. For example, the adapter sleeve 1214 and the mating adapter 1216 may include mating threads such that adapter sleeve 1216 and components attached thereto may be removed from the outer tube 1201. The adapter sleeve 1214 and the mating adapter 1216 may be configured as described with respect to the adapter sleeve 1128 and the mating adapter 1126 discussed above.

Figure 13A:
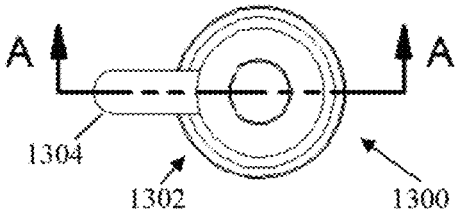
FIG. 13A illustrates a top view of the flow through heating device of FIG. 12.

FIG. 13A illustrates a top view of a flow through heater 1300, which is similarly configured to the flow through heaters 1114 and 1200 of FIGS. 11-12, according to one or more embodiments. The flow through heater 1300 includes a More specifically, FIG. 13A illustrates a top end 1302 of the flow through heater 1300 and thus illustrates several of the components thereof as a series of concentric circles. For example, FIG. 13A illustrates a top fitting configured to be received within a lid of a water tank, a cylindrical body member a top edge of an adapter sleeve, and a flange of the adapter sleeve that is configured to be seated over or under a floor of the hot water tank. In addition, FIG. 13A an outlet tube 1304 extending laterally therefrom.

FIG. 13B depicts a side cross-section view of the flow through heater 1300 of FIG. 13A along line A-A. Here, the flow through heater 1300 includes a body or outer tube 1312 extending along a central axis Z between the top end 1302 and a bottom end 1310. In this embodiment, the flow through heater 1300 comprises an outlet tube 1304 that laterally extends from an outlet location 1304' formed into the outer tube 1312 and then downwardly extends to an outlet orifice 1306, where fluid heated by the flow through heater 1300 exits the outlet tube 1304 at the outlet orifice 1306. An inlet orifice 1308 may be provided at various locations, for example, proximate to the bottom end 1310 of the flow through heater 1300. Here, the outer tube 1312 is integrally attached to an adapter sleeve 1322, and the inlet orifice 1308 is formed within the adapter sleeve 1322 that is in fluid communication with the outer tube 1312 such that fluid flows into the adapter sleeve 1322 and then may flow there-through into the outer tube 1312 that is secured to the adapter sleeve 1322. Here, the inlet orifice 1308 is configured within the adaptor sleeve 1322 that is integrally attached to the outer tube 1312. In other embodiments, however, the inlet orifice 1308 may be formed into the outer tube 1312. In even other embodiments, the outer tube 1312 and the adapter sleeve 1322 are made from a monolith component rather than separate components attached together. Also illustrated is an air vent 1318 arranged proximate to the top end 1302 of the flow through heater 1300, which may be included to enhance flow efficiently throughout the system, and thus oriented above the water level/line of a tank. In addition, the flow through heater 1300 may include a top fitting 1320. In this embodiment, the top fitting 1320 is integral with outer tube 1312 at the top end 1302 thereof, and configured to further secure the flow through heater 1300 within a hot water tank, for example, as illustrated in FIG. 11B. In other embodiments, however, the top fitting 1320 may be a separate component attached to the flow through heater 1300 for providing at least a second point of attachment for securing the flow through heater 1300 within a hot water tank.

The flow through heater 1300 also includes a heating element 1314 that is arranged within the outer tube 1312 and provides energy to heat the fluid. In the embodiment illustrated in FIG. 13B, the outer tube 1312 is hollow with a diameter "D" (and radius "R") and open at the bottom end 1310, so as to receive the heating element 1314 therein as illustrated in FIG. 14. In the illustrated embodiment, the bottom end of the heating element 1314 includes an adapter that integrally attached to the heating element 1314 and is configured to engage the interior of the adapter sleeve 1322 so that the heating element 1314 may be removed from the outer tube 1312. Here, the adapter 1322 includes a series of threads that engage corresponding threads within a bore of the adapter sleeve 1322, however, other attachment means may be utilized to selectively attach the heating element 1314 within the outer tube 1312. Also, the mating adapter 1324 may be integrally formed into the heating element 1314 such that the heater element 1314 is made from a monolithic part, whereas in other embodiments, the mating adapter 1324 may be a separate part that is integrally attached to the heating element 1314. In this embodiment, field maintenance is facilitated in that the adapter sleeve 1322 is configured to be installed in a wall of the tank, such as the floor, so that the heating element 1314 of the flow through heater 1300 may be removed and replaced in the field, without complete disassembly or replacement of the water heater system. Also in this embodiment, the outer tube 1312 is closed at the top and configured with the top fitting 1320 for securing the outer tube 1312 in a desired orientation within the tank, such being secured to the lid of the tank in a vertical orientation.

As illustrated, the heating element 1314 includes a hot spot or heating surface 1314' having a diameter "d" (and radius "r"), and a cavity 1316 is defined between an outer surface of the heating element 1314 and the heating surface 1314'. The cavity 1316 may be annular or ring shaped having a ring width x as evaluated between the hot surface 1314' and the inner surface of the outer tube 1312. Thus, the cavity 1316 is formed when the heating element 1314 is installed within the outer tube 1312. In embodiments where both an inner surface of the outer tube 1312 and the heating surface 1314' have uniform or constant diameters along the central axis Z, the cavity 1316 formed therebetween will may be an annular cavity having uniform dimensions (i.e., the ring width x may be constant or uniform) when evaluated at various points along the central axis Z. However, the cavity 1316 may be differently dimensioned and have different geometries depending on the characteristics and/or contours of the inner surface of the outer tube 1312 and the heating surface 1314'. For example, either or both of the heating surface 1314' and the inner surface of the outer tube 1312 may include ridges or have curvatures such that the cavity 1316 defined there-between may not be uniform along the central axis Z. Thus, the ring width x of the cavity 1316 may vary when evaluated along the length of the central axis Z. In the illustrated embodiment, the ring width x of each cross section of the cavity 1316 is equal to the inner radius of the outer tube (i.e., radius R) minus the outer radius of the heating element (i.e., radius r); however, in other embodiments, these dimensions may vary along the central axis Z so as to provide channels, baffles, contours, ridges, etc.

FIG. 13B also depicts the internal cavity/volume that is defined by the outer tube 1312 and into which the heating element 1314 may be inserted. More specifically, this figure depicts the orientation of heating surface 1314' of heating element 1314 within the internal cavity, and illustrates the location 1304' at which heated fluid exits the outer tube 1312 and flows into the outlet tube 1304 that extends from outer tube 1312. Here, the heating element 1314 is coaxial with the outer tube 1312 and the heating surface 1314' extends upwards through outer tube 1312, from the bottom end 1310 to a location along the central axis Z that is spaced vertically below the location 1304'. In other embodiments, however, the heating portion 1314' terminates at the same location along the central axis Z as location 1304', or terminates at a location along the central axis Z that is spaced above location 1304'.

In operation, low temperature fluid (i.e., cool fluid or cooler fluid) may enter the flow through heater 1300 through the inlet orifice 1308 that, in the illustrated embodiment, is configured in the adapter sleeve 1322 at the bottom end 1310 of the flow through heater 1300. The cooler fluid is then directed upward within the cavity 1316 and continuously heated by the heating surface 1314' of the heating element 1314 as it moves upward within the outer tube 1312. The movement of fluid through the annular cavity 1316 may be facilitated by a combination of the storage tank water column pressure and thermosiphonic flow. As mentioned above, the cooler fluid has a higher density than the warm fluid and will sink to the bottom, while the heated fluid will rise in the annular cavity 1316, enter the outlet tube 1304, and then exit through the outlet 1306 thereof. In some embodiments, the warmed fluid will exit the outlet 1306 of the outlet tube 1304 until the storage tank reaches the desired hot water temperature.

In other embodiments, the flow through heater assembly 1300 may be differently configured. For example, the flow through heater assembly 1300 may be configured upside down from that which is illustrated in the figures. Thus, the heating element 1314 may extend into the outer tube 1312 from the top end 1302 instead of the bottom end 1310. In such embodiments, adapter sleeve 1322 may be installed in the lid of a hot water tank such that the user may unscrew the adapter 1324 from the top end of a hot water system, rather than a bottom end of a hot water system. In these embodiments, the outlet tube 1304 may be similarly arranged as illustrated so as to deposit hot water at a desired level within the water tank, for example, the outlet tube 1304 may similarly extend downward towards a bottom portion of the water tank to deposit warm water in a cooler region of the tank as detailed herein. However, the outlet tube 1304 may be differently arranged to deposit warm water at different regions of the tank.

FIG. 14 is an exploded view of heating assembly 1400, which is similarly configured to the flow through heaters 1114, 1200, and 1300 of FIGS. 11-13, according to one or more embodiments. FIG. 14 illustrates the manner in which the heating element 1410 may be assembled within outer tube 1420. Here, the heating element 1410 and the outer tube 1420 both include a base 1412 and 1422, respectively, that facilitate installation of the heating element 1410 within outer tube 1422 such that a replaceable heating rod 1414 of heating element 1410 extends into the internal cavity of outer tube 1420 without contacting the inner sidewalls thereof, so as to form the cavity detailed above. Here, the base 1412 comprises a threaded adapter 1416 and a nut 1418 that facilitates installation of heating element 1410 within outer tube 1420. The base 1422 of the outer tube 1420 includes an adapter sleeve as discussed above. Accordingly, the base 1422 is an adapter sleeve having a bore portion 1424 that may be threaded with threads 1426, which are configured to mate with the threaded portion 1416 of the heating element 1410. In the illustrated embodiment, the lower end of the flow through heater 1400 protrudes outward from and external of the bottom of the hot water tank such that a user may disengage the heating element base 1412 from the outer tube base 1422, for example, to remove and replace the replaceable heating rod 1414 of heating element 1410 as needed, or to replace the heating element 1410 with a new unit heating element 1410 altogether. However, other means may be utilized to secure bases 1412 and 1422 together. Thus, base portions 1412 and 1422 generally facilitate installation and maintenance, especially when in the field, and provide operators a simple means to replace the heating elements as needed and without having to remove the heating assembly from the larger hot water tank system.

As previously discussed, embodiments of the flow through heater disclosed herein provide numerous advantages compared to prior art heating devices. For example, flow through heaters disclosed herein may quickly raise the temperature of the water in a hot water tank to the desired temperature, and extend the time over which water may be drawn from the hot water tank. An embodiment of the presently disclosed flow through heater was installed in a water tank and tested. In this test, the outlet temperature of water flowing out of the tank (utilizing the flow through heater) at a continuous flow at 0.5 gallons per minute (USGPM) was measured for 25 seconds, and the results of this test are illustrated as a trend line 1510 in FIG. 15. These results (i.e., the trend line 1510) were compared to data obtained when testing a prior art heater under similar conditions, where the results of the prior art heater testing are illustrated as a second trend line 1520 in FIG. 15. Thus, FIG. 15 is a graph comparing performance of the presently disclosed flow through heater (i.e., the first trend line 1510) to the performance of a prior art heater (i.e., the second trend line 1520). Also, the initial warm up time for water tanks using embodiments of the presently disclosed flow through heater were also tested, and then compared to water tanks using prior art heaters. In these tests, the water tanks were filled with 1.50 quarts (or 1.42 liters) of water, and the presently disclosed flow through heater was able to heat the water in the water tank to 61 degrees Celsius (or 142 degrees Fahrenheit) in about 9 minutes, whereas prior art heaters were able to heat the water in the water tank to 53 degrees Celsius (or 127 degrees Fahrenheit) in 15 minutes.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example" and so on, indicate that the embodiment(s) or example(s) so described may include a particular feature, structure, characteristic, property, element, or limitation, but that not every embodiment or example necessarily includes that particular feature, structure, characteristic, property, element, or limitation.

What is claimed is:

1. A heater comprising:

a hollow body configured to couple to an interior of a fluid tank, the hollow body having an inlet and an outlet that is in fluid communication with the inlet, the inlet being spaced away from the outlet;

a heating element arranged within the hollow body, the heating element having a heating surface configured to heat fluid flowing through the hollow body;

a cavity formed between the heating surface of the heating element and an interior surface of the hollow body;

an outlet tube extending externally from the outlet of the hollow body towards the inlet of the hollow body for depositing heated fluid within the fluid tank, wherein the outlet tube is in fluid communication with the inlet of the hollow body; and an adapter sleeve arranged at a lower end of the hollow body, wherein the inlet of the hollow body is arranged in the adapter sleeve.

2. The heater of claim 1, wherein the hollow body is a cylinder.

3. The heater of claim 1, wherein the heating element is arranged coaxially within the hollow body.

4. The heater of claim 1, wherein the hollow body includes an opening at the bottom end and the heating element extends through the opening at the bottom end.

5. The heater of claim 1, wherein a distance between the interior surface of the hollow body and the heating surface of the heating element is greater than or equal to 1 mm.

6. The heater of claim 5, wherein the distance between the interior surface of the hollow body and the heating surface of the heating element is less than or equal to twice a diameter of the heating surface.

7. The heater of claim 1, wherein a distance between the interior surface of the hollow body and the heating surface of the heating element is less than or equal to twice a diameter of the heating surface.

8. The heater of claim 1, wherein a diameter of the inlet of the hollow body is less than or equal to twice a distance between the heating surface of the heating element and an interior surface of the hollow body.

9. The heater of claim 1, wherein the outlet is arranged along a central axis of the hollow body and spaced from the inlet of the hollow body by a distance of at least three times a diameter of the inlet.

10. The heater of claim 1, wherein the outlet location is spaced from the inlet of the hollow body by a distance of at least three times a diameter of the inlet.

11. The heater of claim 1, wherein the cavity is an annular cavity.

12. The heater of claim 1, wherein the heating element includes an adapter arranged at a bottom end of the heating element.

13. The heater of claim 12, wherein the adapter is removably received within the adapter sleeve.

14. The heater of claim 13, wherein an external surface of the adapter and an inner bore of the adapter sleeve include mating threads.

15. The heater of claim 14, wherein the adapter includes a nut for threading the adapter within the adapter sleeve.

16. The heater of claim 1, wherein the hollow body includes a vent at the top end thereof, and wherein the outlet is disposed between the inlet and the vent.

17. A heater comprising:

a hollow body having an inlet and an outlet that is in fluid communication with the inlet, wherein the hollow body comprises a first coupling portion configured to couple the hollow body to a tank;

a second coupling portion threadably connected to the first coupling portion;

a heating element removably arranged within an interior of the hollow body, the heating element being connected to the second coupling portion of the hollow body, the heating element having a heating surface configured to heat fluid flowing through the hollow body; and an outlet tube extending externally from the outlet of the hollow body, wherein the inlet is defined in the first coupling portion.

18. A heater comprising:

a hollow body having an inlet and an outlet that is in fluid communication with the inlet, the inlet located at a bottom end of the hollow body and the outlet spaced away from the inlet towards a top end of the hollow body;

a heating element removably arranged within an interior of the hollow body, the heating element being threadably connected to the hollow body at the bottom end of the hollow body, the heating element having a heating surface configured to heat fluid flowing through the hollow body;

an outlet tube extending externally from the outlet of the hollow body towards the inlet of the hollow body for depositing heated fluid, wherein the is in fluid communication with the inlet of the hollow body; and an adapter sleeve arranged at the bottom end of the hollow body, wherein the inlet of the hollow body is arranged in the adapter sleeve.

* * * * *